US010638850B2

(12) United States Patent
Skaggs

(10) Patent No.: US 10,638,850 B2
(45) Date of Patent: May 5, 2020

(54) FOLDING BED BASE APPARATUS AND RELATED METHOD OF USE

(71) Applicant: DOCKTER CHINA LIMITED, Dongguan (CN)

(72) Inventor: Robert William Skaggs, Dongguan (CN)

(73) Assignee: Dockter China Limited, Hong Kong (HK)

( * ) Notice: Subject to any disclaimer, the term of this patent is extended or adjusted under 35 U.S.C. 154(b) by 306 days.

(21) Appl. No.: 15/673,466

(22) Filed: Aug. 10, 2017

(65) Prior Publication Data

US 2019/0045938 A1 Feb. 14, 2019

(51) Int. Cl.
*A47C 19/12* (2006.01)
*A47C 19/02* (2006.01)

(52) U.S. Cl.
CPC ..... *A47C 19/122* (2013.01); *A47C 19/025* (2013.01)

(58) Field of Classification Search
CPC ..... A47C 19/122; A47C 19/025; A47C 17/70; A47C 19/12; A47C 19/02; F16B 12/56; A47D 7/002; Y10T 16/53615
USPC ..... 5/174
See application file for complete search history.

(56) References Cited

U.S. PATENT DOCUMENTS 4,048,683 A * 9/1977 Chen ..... A47C 19/122 5/180
4,143,434 A * 3/1979 Monot ..... A47C 17/82 5/114
5,090,071 A * 2/1992 Bathrick ..... A47C 19/122 5/174
5,257,428 A * 11/1993 Carroll ..... A47C 19/122 5/201
8,370,973 B1 2/2013 Oh
8,769,740 B2 * 7/2014 Oh ..... A47C 19/12 5/174
9,226,590 B1 * 1/2016 Hull ..... F16B 12/56
9,456,699 B1 * 10/2016 Oh ..... A47C 19/122
2004/0183267 A1 * 9/2004 Tokarev ..... A47C 19/122 280/47.34
2016/0157621 A1 * 6/2016 Oh ..... A47C 19/12 5/202

(Continued)

*Primary Examiner* — Peter M. Cuomo
*Assistant Examiner* — Myles A Throop
(74) *Attorney, Agent, or Firm* — Jacob C. Ong; Ongs Law Firm, PLLC

(57) ABSTRACT

A folding bed base apparatus may include a central frame assembly, a head section, and a foot section. The head section and foot section may be pivotally attached to the central frame assembly such that the folding bed base apparatus may fold to a folded configuration and unfold to an unfolded configuration. The central frame assembly may include a first U-shaped foot rest and a second U-shaped foot rest. The U-shaped foot rests may allow the folding bed base apparatus to stand upright when in the folded configuration. The head section may include a first pivot bar and pivot bar stops which frictionally-obstruct the head section from unfolding past the unfolded configuration. The foot section may include a second pivot bar and pivot bar stops which frictionally-obstruct the foot section from unfolding past the unfolded configuration. Methods for unfolding a folded folding bed base apparatus are disclosed.

20 Claims, 14 Drawing Sheets

(56) References Cited

U.S. PATENT DOCUMENTS

| | | | | |
|---|---|---|---|---|
| 2016/0157622 | A1* | 6/2016 | Oh | A47C 19/122<br>5/203 |
| 2016/0206111 | A1* | 7/2016 | Oh | A47C 19/122 |
| 2016/0262547 | A1* | 9/2016 | Jin | A47C 19/12 |
| 2016/0316921 | A1* | 11/2016 | Choi | A47C 19/122 |
| 2017/0119166 | A1* | 5/2017 | An | A47C 19/122 |
| 2018/0255936 | A1* | 9/2018 | Choi | A47C 19/122 |

* cited by examiner

FOLDING BED BASE APPARATUS AND RELATED METHOD OF USE

BACKGROUND OF THE INVENTION

1. Field of the Disclosure

The disclosure generally relates to bed bases, which are bed frames that may be covered in a soft material and are configured to support a mattress, which may or may not have spring coils. A bed base may be referred to as a box-spring apparatus, which may or may not have spring coils. The disclosure relates to bed bases which are foldable, which may be more cost-effective when being transported to a warehouse, store, or customer.

Beds typically include a mattress that rests on a bed base that is supported by a bed frame. Typical bed bases are made to appear like a mattress. Typically, bed bases include knitted fabric and cushioning. Many bed bases have a frame that is rectangular, and the frame often supports rows of coil springs to provide support for a mattress.

A typical bed base may be constructed from wood and may have the same dimensions as a mattress. A typical bed base may have a relatively stiff wooden frame, which may make it awkward to handle. Consumers may experience difficulty when transporting a typical bed base. Many consumers may not be able to fit a conventional bed base into their cars and may need to hire a shipping company or strap down the bed base to the roof of their car.

2. Background Art

Conventional beds generally include a mattress resting on a bed base that is supported by a bed frame. Bed bases are generally designed to have the outward appearance of a mattress, being covered by quilted fabric and cushioning, for example. Generally, bed bases have a wooden rectangular frame supporting an array of springs to provide firm support for the mattress.

A bed base is typically constructed in one piece having the same dimensions as the mattress it supports. A typical bed base is often heavy and awkward to handle. The size of a conventional bed base often does not fit in the trunk of a car or in narrow spaces like elevators. The size of a conventional bed base may take up valuable floor space at a retail store.

A support for a mattress is desired that provides all or many of the qualities of a conventional bed base but yet surpasses the transportation and storage space requirements of a conventional bed base and is even more convenient for the user to use.

SUMMARY OF THE INVENTION

In one embodiment, a folding bed base apparatus may include a central frame assembly, a head section, and a foot section. Generally, the head section and the foot section pivotally attach to the central frame assembly such that they may be folded up in a folded configuration and unfolded to an unfolded configuration.

The central frame assembly may include a first hinge body, a second hinge body, and a central support bar. A distal end of the central support bar may be coupled to the and a proximal end of the central support bar may be coupled to the second hinge body. The first hinge body may include a first upper horizontal member and a first lower horizontal member and the second hinge body may include a second upper horizontal member and a second lower horizontal member.

The head section may include a first upper frame, a first lower frame, a first pivot bar, a first pivot bar stop, and a second pivot bar stop. The first upper frame may pivotally attach to both the first upper horizontal member and to the second upper horizontal member. The first lower frame may pivotally attach to both the first lower horizontal member and to the second lower horizontal member. The first pivot bar may be pivotally attached to the first lower frame. The first pivot bar stop of the first lower frame and the second pivot bar stop of the first lower frame may be coupled to the first lower frame such that, working together with the first pivot bar, the pivot bar stops and the first pivot bar frictionally-obstructs the head section from continuing to pivot in a counter-clockwise direction, when unfolded from a folded configuration, past the unfolded configuration.

The foot section may include a second upper frame, a second lower frame, a second pivot bar, a first pivot bar stop, and a second pivot bar stop. The second upper frame may pivotally attach to both the first upper horizontal member and to the second upper horizontal member opposite of the attachments of the first upper frame. The second lower frame may pivotally attach to both the first lower horizontal member and to the second lower horizontal member opposite of the attachments of the first lower frame. The second pivot bar may be pivotally attached to the second lower frame. The first pivot bar stop of the second lower frame and the second pivot bar stop of the second lower frame may be coupled to the second lower frame such that, working together with the second pivot bar, the pivot bar stops and the second pivot bar frictionally-obstructs the foot section from continuing to pivot in a clockwise direction, when unfolded from a folded configuration, past the unfolded configuration.

The first hinge body may further include a first medial leg support to which a first U-shaped foot rest may be removably attached. The second hinge body may also further include a second medial leg support to which a second U-shaped foot rest may be removably attached. The first and second U-shaped foot rests may help the folding bed base apparatus to stand upright when in the folded configuration. Regarding to connector bar which affix centrally or substantially centrally, relative to the frame, to the hinge bodies, beveling may or may not be included on the ends. As disclosed in the figures, the beveling may be on the upper edge of the connector rod, the lower edge of the connector rod, or on both the upper edge and the lower edge of the connector rod. Beveling may be present on all or some of the connector rod edges; see FIG. 6 which discloses beveling on all eight of the connector rod edges. The angle of the beveling surface may be curved, a combination of curved and angled straight edge, or an angled straight edge between 1 degree and 10 degrees, 11 degrees and 20 degrees, 21 degrees and 30 degrees, 41 degrees and 50 degrees, 51 degrees and 60 degrees, 61 degrees and 70 degrees, or 81 degrees and 90 degrees.

BRIEF DESCRIPTION OF THE DRAWINGS

The preferred embodiments of the present invention will be described in conjunction with the appended drawings. Like designations denote like elements, and.

DETAILED DESCRIPTION OF THE INVENTION

It will be readily understood that the components of the present invention, as generally described with reference to the drawings herein, could be implemented in a wide variety of different configurations. Thus, the following more detailed description of the embodiments of the system and method of the present invention, is not intended to limit the scope of the invention, but is merely representative of various embodiments of the invention. Unless explicitly stated, the use of "or" means and/or, that is, this the non-exclusive meaning of or.

Reference to an aperture-area does not refer to an empty space but refers to a localized, torus-shaped area of an object surrounding an aperture which may be defined by a radius that is 2 mm greater than the radius which defines the aperture.

Figure 1:
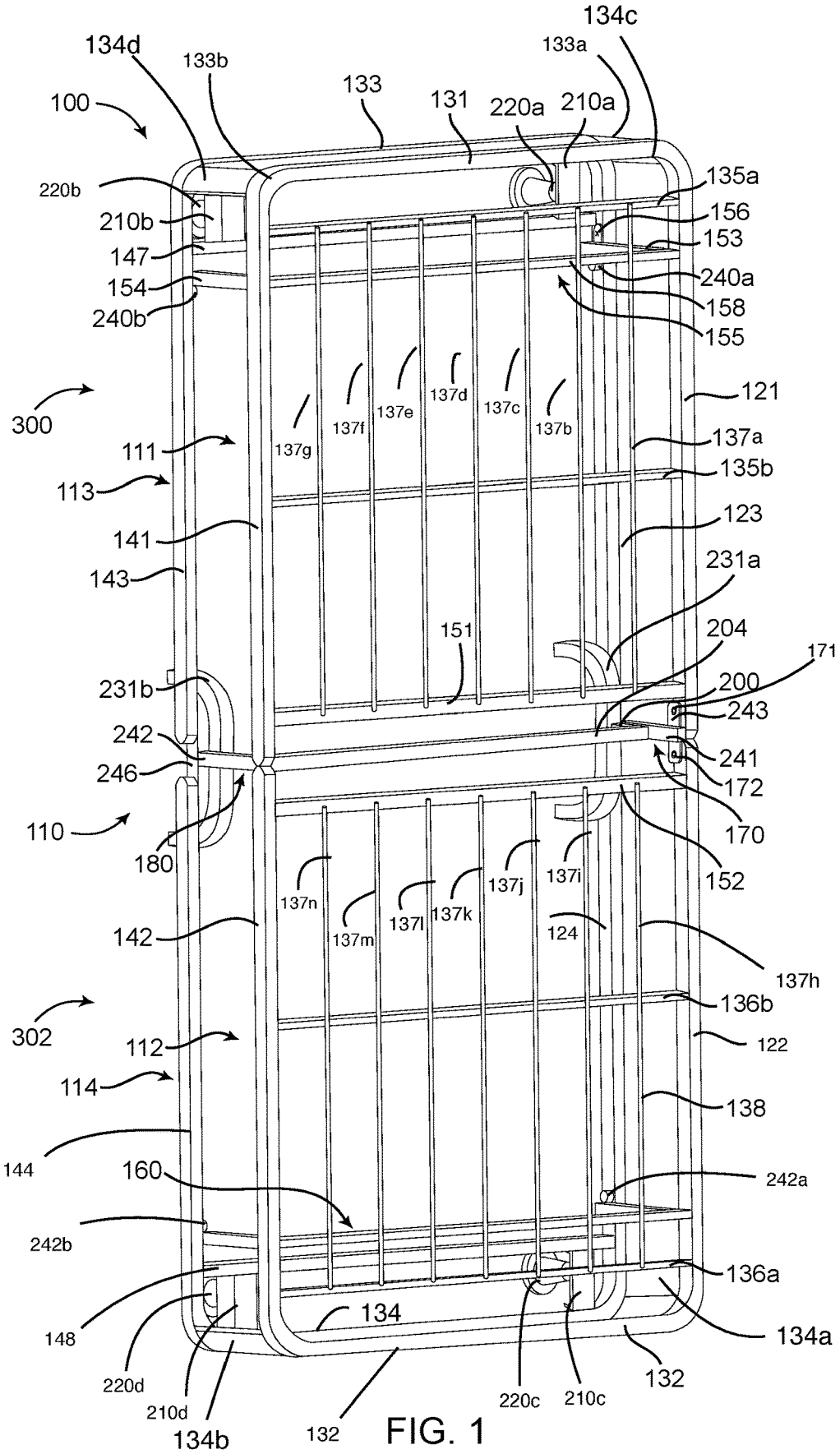
FIG. 1 illustrates a top perspective view of a folding bed base apparatus embodying the present invention.
Figure 8:
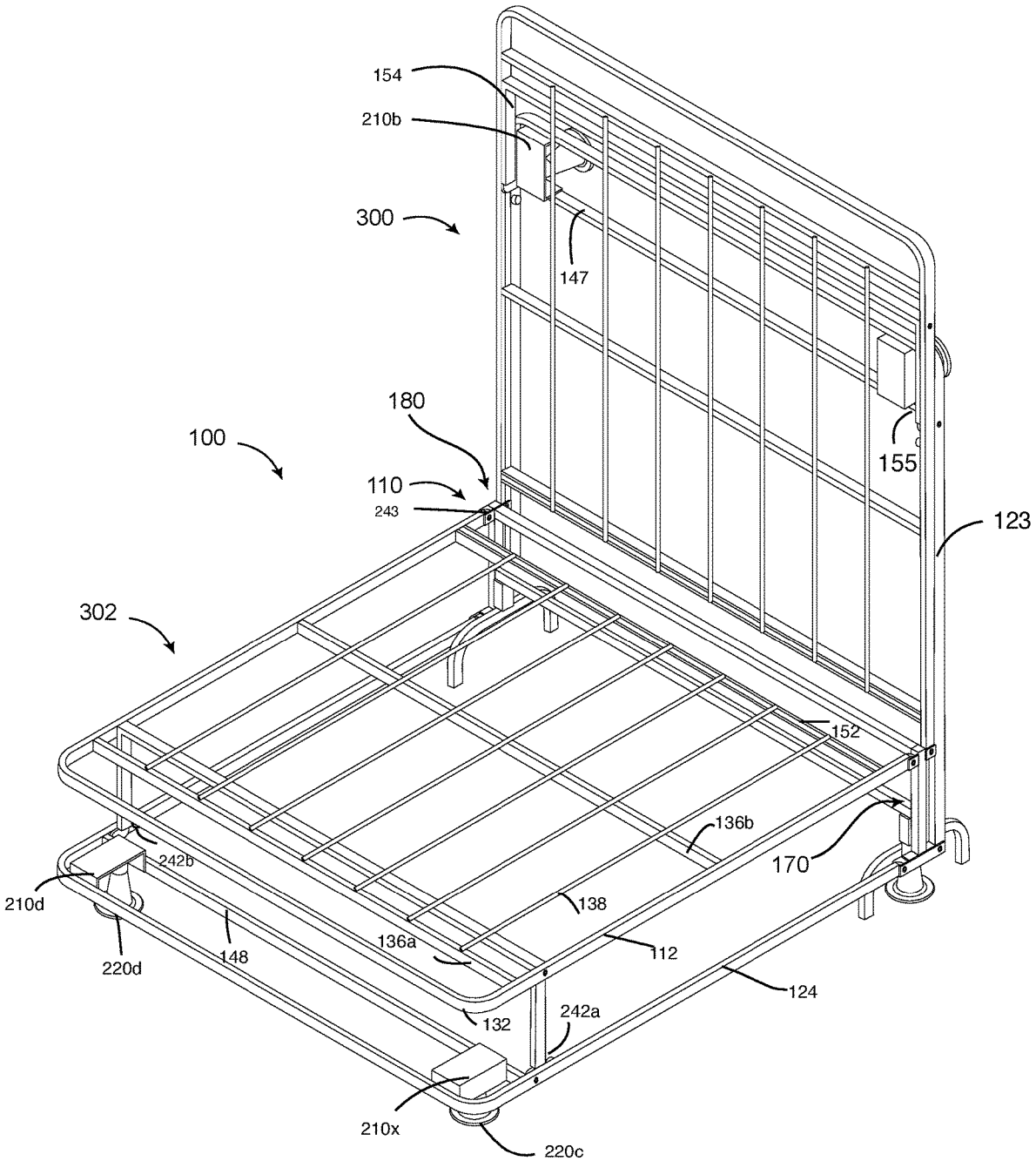
FIG. 8 illustrates a perspective view of the folding bed base apparatus of FIGS. 1-6 in a partially folded position.
Figure 9:
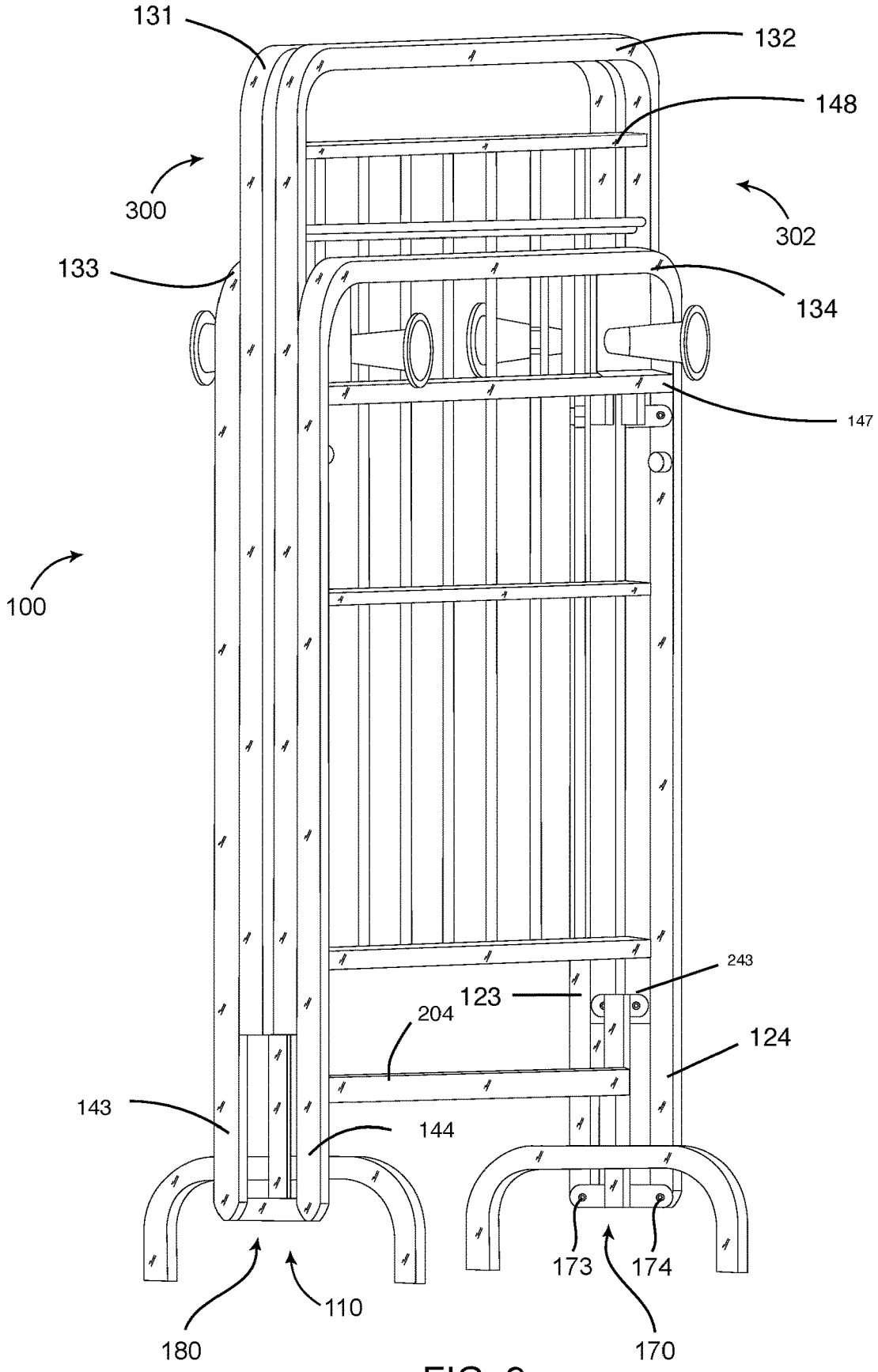
FIG. 9 illustrates a perspective view of the folding bed base apparatus of FIGS. 1-6 and 8 in a completely folded storage position.

A folding bed base apparatus (100) generally has two configurations, an unfolded configuration—see FIG. 1—and a folded configuration—see FIG. 9. FIG. 8 depicts what may be referred to as a semi-folded configuration of a folding bed base apparatus (100). In the unfolded configuration, the folding bed base apparatus (100) may function to raise the soft mattress's height, making it easier for a user to get into and out of bed, may absorb shock, reducing wear to the soft mattress, and may provide a flat and sturdy structure for the soft mattress to lie upon. In the folded configuration, the folding bed base apparatus (100) may be flatter than the unfolded configuration of the folding bed base apparatus and may take up a smaller area as compared to the folding bed base apparatus (100) in the unfolded configuration. Consequently, when the folding bed base apparatus (100) is in the folded configuration, the folding bed base apparatus 100 may be easier to transport and to store when not in use.

Figure 2:
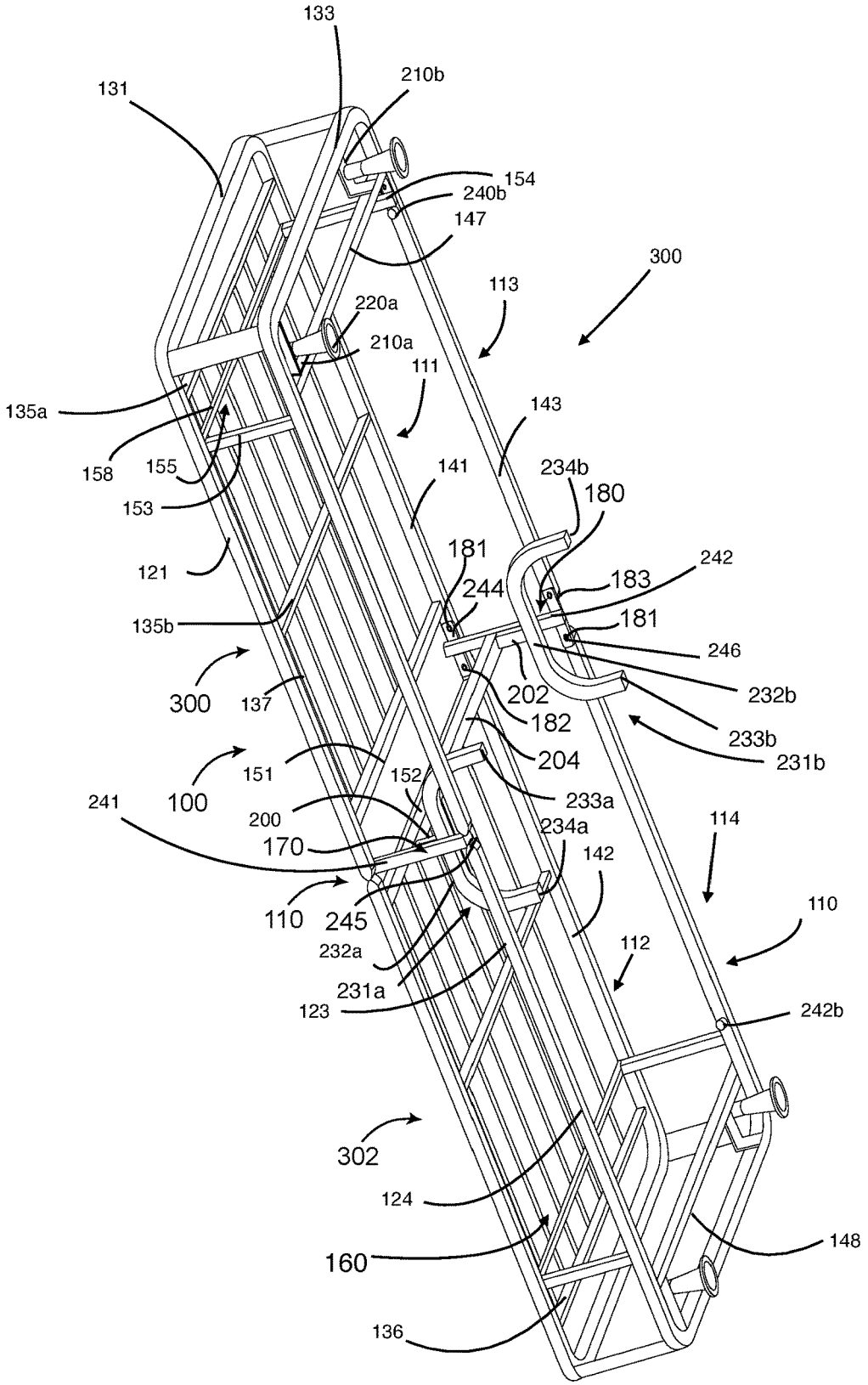
FIG. 2 illustrates a bottom perspective view of the folding bed base apparatus of FIG. 1.

FIG. 1 illustrates a top perspective view of the folding bed base apparatus (100) in the unfolded configuration and FIG. 2 illustrates a bottom perspective view of the folding bed base apparatus (100) in the unfolded configuration. The folding bed base apparatus (100) may be generally symmetrical about a central frame assembly (110) which may split the folding bed base apparatus (100) into two sections, the head section (300) and the foot section (302). The central frame assembly (110) may be generally comprised of a central support bar (204), a first hinge body (170), a second hinge body (180), a first U-shaped foot rest (231*a*) being coupled to a first medial leg support (200), which may be referred to as a U-shaped foot rest support, which may be coupled to the central bar (204), and a second U-shaped foot rest (231*b*) being coupled to a second medial leg support (202), which may be referred to as a U-shaped foot rest support, which may be coupled to the central bar (204). A U-shaped foot may have a receiving slot, not shown, for receiving the foot rest support. The first hinge body (170) may include a first medial leg support (200) coupled to an inward-facing face, i.e., facing the second medial leg support of the first vertical bar (241). In some embodiments, the U-shaped foot rest support is coupled to a vertical bar of a hinge body; in other embodiments, the U-shaped foot rest support is separated from a vertical bar of the hinge body by a vertical column of space; being separated from a vertical bar does not preclude the vertical bar being coupled to the central bar (204) while the foot rest support is also being coupled to the central bar (204). In some embodiments, the U-shaped foot rest may be generally E-shaped having a central bar; the U-shaped foot rest may have any number of projecting bars that contact the ground and extend from upper arch portion of the U-shaped foot rest; in the FIG. 1 the U-shaped foot rests are depicted as having two projecting bars, that is one on each end, which contact the floor. The head section (300) may be generally comprised of a first upper frame (111), a first lower frame (113), and a first pivot bar (155).

The foot section (302) may be generally comprised of a second upper frame (112), a second lower frame (114), and a second pivot bar (160). Generally speaking, the first upper frame (111) and the second upper frame (112) may both be pivotally attached to the upper hinges of the first hinge body (170) and the second hinge body (180). See FIG. 1 for a depiction of how the first hinge body (170) may be pivotally attached to the first upper frame. Similarly, the first lower frame (113) and the second lower frame (114) may both be pivotally attached to the first hinge body (170) and to the second hinge body (180). The first pivot bar (155) may function to keep the first upper frame (111) in a substantially horizontal position, when the first pivot bar (155) is vertically-aligned and orthogonally-aligned with respect to the ground and when the folding bed base apparatus (100) is in the unfolded configuration. Likewise, the second pivot bar (160) may function to keep the second upper frame (112) in a horizontal position, when the second pivot bar (160) is vertically-aligned and orthogonally-aligned with respect to the ground and when the folding bed base apparatus (100) is in the unfolded configuration.

As mentioned above, the central frame assembly (110) may include a central support bar (204), a first hinge body (170), a second hinge body (180), a first U-shaped foot rest (231*a*), and a second U-shaped foot rest (231*b*). The central support bar (204) in the preferred embodiments is an elongated rectangular cuboid but may also be an elongated rectangular cuboid with curved edges, a cylindrical bar, a flat bar, an L-bar, or any other kind of bar known in the art.

Figure 6:
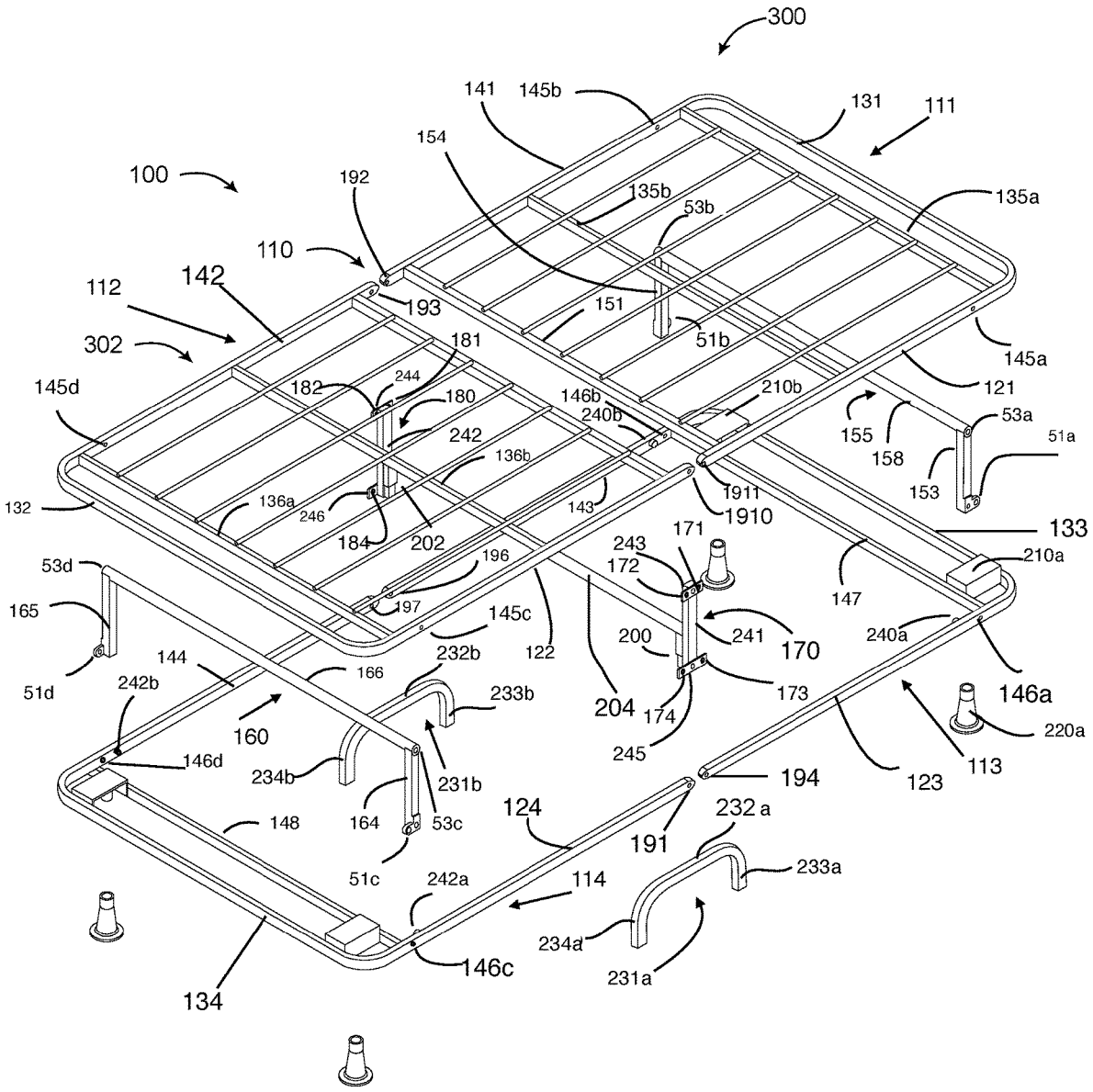
FIG. 6 illustrates an exploded perspective view of the folding bed base apparatus of FIGS. 1-5; any conflict in element numbering that cannot be resolved by common sense shall be resolved by using FIG. 6 as the standard.

Embodiments of the first medial-facing end aperture-area (1040*a*), the second medial-facing end aperture-area (1040*b*), the third medial-facing end aperture-area (1040*c*), and the fourth medial-facing end aperture-area (1040*d*) are depicted in FIG. 6.

The first hinge body (170) may include a first vertical bar (241), a first upper horizontal member (243), a first lower horizontal member (245, not shown in FIG. 1), A distal end of the central support bar (204) may be coupled to the first vertical bar (241) at the center, near the center, or offset from the center of the of the first vertical bar (241). When the distal end of the central support bar (204) is coupled to the first vertical bar (241), the point of contact between the central support bar (204) and the first vertical bar (241) divides a superior section of the first vertical bar (241) from an inferior section of the first vertical bar (241), in which the inferior section is closer to the end of the footrests compared to how close the superior section is located to the footrests. The first upper horizontal member (243) may be coupled laterally to a superior end of the first vertical bar (241). The first lower horizontal member (245) may be coupled laterally to an inferior end of the first vertical bar (241). In some embodiments, the first medial leg support (200) may be coupled medially to the inferior half of the first vertical bar (241). The first medial leg support (200) may include a first member coupled to a second member; the second member may be narrower in width than the first member; the second member may be configured to receive a U-shaped foot rest. For further structural strength, a superior end of the first medial leg support (200) may also extend to and be coupled to the distal end of the central support bar (204). An inferior end of the first medial leg support (200) may be removably attached to the first U-shaped foot rest (231*a*) by nut and bolt, clip, or any other removable attachment known in the art. Alternatively, the first U-shaped foot rest (231*a*) may be permanently coupled to the inferior end of the first medial leg support (200) by weld, mold, or any other form of permanent attachment known in the art.

The second hinge body (180) may include a second vertical bar (242), a second upper horizontal member (244), a second lower horizontal member (246). A proximal end of the central support bar (204) may be coupled to the second vertical bar (242) at the center, near the center, or off-center of the center of the second vertical bar (242) and may define a superior half of the second vertical bar (242) and an inferior half of the second vertical bar (242). See also FIG. 2. The second upper horizontal member (244) may be coupled laterally, but centrally in the preferred embodiments, to a superior end of the second vertical bar (242). The second lower horizontal member (246) may be coupled laterally, but centrally in the preferred embodiments, to an inferior end of the second vertical bar (242). The second medial leg support (202) may be coupled to the inferior half of the second vertical bar (242), or a superior portion of the second medial leg support may be coupled to the central support bar (204) at a location closer to the center of the apparatus than the location of the second hinge body (180) so that a gap exists between the second medial leg support (202) and the second vertical bar (242). For further structural strength, a superior end of the second medial leg support (202) may also extend to and be coupled to the proximal end of the central support bar (204). An inferior end of the second medial leg support (202) may be removably attached to the second U-shaped foot rest (231*b*) by nut and bolt, clip, or any other means of removable attachment known in the art. Alternatively, the second U-shaped foot rest (231*b*) may be permanently coupled to the inferior end of the first medial leg support (200) by weld, mold, or other form of permanent attachment known in the art.

The first upper horizontal member (243) may be a substantially flat member coupled, such as centrally coupled, to the superior lateral end of the first vertical bar (241) such that the first upper horizontal member (243) may be orthogonal to the first vertical bar (241), a first end of the first upper horizontal member (243) may extend toward the head section (300), and a second end of the first upper horizontal member (243) may extend toward the foot section (302). A first hinge aperture-area (171) may be defined in the first end of the first upper horizontal member (243), and a second hinge aperture-area (172) may be defined in the second end of the first upper horizontal member (243).

The second upper horizontal member (244) may be substantially flat and coupled to the superior end of the second vertical bar (242) such that the second upper horizontal member (244) may be orthogonal to the second vertical bar (242), a first end of the second upper horizontal member (244) may extend toward the head section (300), and a second end of the second upper horizontal member (244) may extend toward the foot section (302). A third hinge aperture-area (181) may be defined in the first end of the second upper horizontal member (244), and a fourth hinge aperture-area (182) may be defined in a second end of the second upper horizontal member (244).

The first lower horizontal member (245) of the first hinge body (170) may be a substantially flat bar coupled, such as centrally coupled, to the inferior end of the first vertical bar (241) such that the first lower horizontal member (245) may be orthogonal to the first vertical bar (241), a first end of the first lower horizontal member (245) may extend toward the head section (300), and a second end of the first lower horizontal member (245) may extend toward the foot section (302). The first lower horizontal member (245) may be coupled, such as centrally coupled, to the inferior end of the first vertical bar (241). A fifth hinge aperture-area (173) may be defined in the first end of the first lower horizontal member 245, and a sixth hinge aperture-area (174) may be defined in the second end of the first lower horizontal member (245). In the preferred embodiments, the fifth hinge aperture-area (173) and the sixth hinge aperture-area (174) are spaced further apart than the first hinge aperture-area (171) is spaced from the second hinge aperture-area (172).

The second lower horizontal member (246) may be a flat member coupled, such as centrally coupled, to the inferior lateral-facing end of the second vertical bar (242) such that the second lower horizontal member (246) may be orthogonal to the second vertical bar (242), a first end of the second lower horizontal member (246) may extend toward the head section (300). The view of the first end of the second lower horizontal member (246) is obscured in FIG. 6 due to the viewing angle, and a second end of the second lower horizontal member (246) may extend toward the foot section (302). A seventh hinge aperture-area (183), show in FIG. 2, may be defined in the first end of the second lower horizontal member (246), and an eighth hinge aperture-area (184) may be defined in the second end of the second lower horizontal member (246). In some preferred embodiments, the spacing distance between the third hinge aperture-area (181) and the fourth hinge aperture-area (182) may be substantially similar, or identical, and aligned with the spacing distance between the first hinge aperture-area (171) and the second hinge aperture-area (172). The spacing between the seventh hinge aperture-area (183) and the eighth aperture-area (184) may be substantially similar, or identical, and aligned with the fifth hinge aperture-area (173) and the sixth hinge aperture-area (174).

The first U-shaped foot rest (231*a*) may be generally comprised of a horizontal section (232*a*), a first foot (233*a*), and a second foot (234*a*) (as best seen in FIG. 6). The first U-shaped foot rest (231*a*) may resemble an upside-down elongated U-shape, and may be a rectangular cuboid bar, a cylinder, rectangular cuboid bar with curved edges, or other bar known to persons of ordinary skill in the art, which curves downward at a first end to form the first foot (233*a*) and curves downward at a second end to form the second foot (234*a*). The first U-shaped foot rest (231*a*) may be disposed in other configurations. For example, the first foot (233*a*) and the second foot (234*a*) may be coupled to the horizontal section (232*a*) so as to each form a ninety degree angle with the horizontal section (232*a*); in other embodiments, a curved transition defines the connecting area between the feet and the horizontal section of the U-shaped foot rest, such as between the first foot (233*a*) and the horizontal section (232*a*). The horizontal section (232*a*) may be configured to removably attach to the first medial leg support (200) by being threadedly attached, by bolt and nut, by pushpin, by clip, or by any other means of removable attachment known in the art. Alternatively, the horizontal section (232*a*) may be permanently coupled to the first medial leg support (200) by weld, mold, or any other means known in the art.

Similarly, the second U-shaped foot rest (231*b*) may be generally comprised of a horizontal section (232*b*), a first foot (233*b*), and a second foot (234*b*) (as best seen in FIG. 6). The second U-shaped foot rest (231*b*) may be substantially similar to the first U-shaped foot rest (231*a*) described above. However, the second U-shaped foot rest (231*b*) may not be limited to being identical to the first U-shaped foot rest (231*a*). For example, the second U-shaped foot rest (231*b*) may be of different size and dimension from the first U-shaped foot rest (231*a*).

The head section (300) may be generally comprised of a first upper frame (111), a first lower frame (113), and a first pivot bar (155). The first upper frame (111) may be comprised of a distal side bar (121), a proximal side bar (141), a lateral end bar (131), a medial end bar (151), one or more support bars (135*a*, 135*b*), and a plurality of support rods (137*a*-137*g*). Likewise, the foot section may also include support rods (137*h*-137*n*) The support rods of support rod (137*a*) through (137*g*) are identifiable in the preferred embodiments as being parallel to each of the other support rods. The distal side bar (121) may be parallel to the proximal side bar (141). The medial end bar (151) and one or more support bars (135), preferably at least support bar (135*a*) and support bar (135*b*), may be orthogonal to both the distal side bar (121) and the proximal side bar (141). The medial end bar (151) and the one or more support bars (135) may be coupled to medial sides of the distal side bar (121) and the proximal side bar (141). The medial end bar (151) may be coupled to the first distal side bar (121) near or at the medial ends of the distal side bar (121), and the medial end bar (151) may be coupled to the proximal side bar (141) near or at the medial ends of the proximal side bar (141), but, in some preferred embodiments, the location where the medial end bar (151) couples to the proximal side bar (141) or the distal side bar (121) may be slightly laterally inset from the medial ends of the medial end bar (151) and the distal side bar (121). Support bar (135*a*) may be coupled to a lateral end area of the proximal side bar (141) and a lateral end area of the distal side bar (121).

In some preferred embodiments, two pivot bars are provided. Pivot bars may include a longitudinal rod a first side bar and a second side bar. When the side bars are vertically-aligned, a pivot bar is generally in the shape of an upside-down "U". The longitudinal rod of the pivot bar may provide a support surface for the support rods. In the preferred embodiments, a pivot bar may be coupled to the lower frame at two opposing locations and also may be coupled to the upper frame at two opposing locations. Referring to FIG. 6, a first pivot bar aperture-area (145*a*) may be defined in the distal side bar (121) of the first upper frame, medially to the location in which the distal side bar (121) couples with the support bar (147). The first pivot bar aperture-area (145*a*) may receive a bolt. Referring to FIG. 6, second pivot bar aperture-area (145*b*) may be defined in the upper proximal side bar (141) of the first upper frame, laterally to the location in which the proximal side bar (143) couples with the support bar (135*b*); the second pivot bar aperture-area may be aligned with the first pivot bar aperture-area (145*a*). Pivot bar aperture-areas (145*a*) and (145*b*) may function as aperture-areas used for affixing the lateral ends of the pivot bar to the proximal side bar (141) or the distal side bar (121), such as an aperture-area for receiving a screw or other affixing mechanism.

Additionally, a first lower pivot bar aperture-area (146*a*) may be defined near the corner of the first lower distal bar. The first lower pivot bar aperture-area (146*a*) may be located medially to the support bar (147), and the first lower pivot bar aperture-area (146*a*) may be coupled to a pivot bar side bar (153) at a pivot side bar connector area (51*a*). A first pivot bar aperture-area (145*a*) may be disposed in distal side bar (121) at a location that is vertically aligned with the first lower pivot bar aperture-area (146*a*). A distal, lateral end (53*a*) of the pivot bar may be pivotally affixed to the first pivot bar aperture-area (145*a*).

Additionally, a second lower pivot bar aperture-area (146*b*) may be defined near the corner of the first lower proximal bar. The second lower pivot bar aperture-area (146*b*) may be located medially to the support bar (147), and the second lower pivot bar aperture-area (146*b*) may be coupled to the pivot bar side bar (154) at a pivot side bar connector area (51*b*). A second upper pivot bar aperture-area (145*b*) may be disposed in proximal side bar (141) at a location that is perpendicular to a location that is located on the proximal side bar and also located between pivot bar stop (240*b*) and support bar (135*a*). A proximal, lateral end (53*b*) of the pivot support bar (158), may be pivotally affixed to the second upper pivot bar aperture-area (145*b*).

Additionally, a third pivot bar aperture-area (146*c*) may be defined near the corner of the second lower distal bar. The third pivot bar aperture-area (146*c*) may be located medially to the support bar (148), and the third pivot bar aperture-area (146*c*) and may be coupled to a distal vertical bar (164) at a pivot side bar connector area (51*c*). A third pivot bar aperture-area (145*c*) may be disposed in distal side bar (124) at a location vertically aligned with the third pivot bar aperture-area (146*c*). A distal, lateral end (53*c*) of the pivot bar may be pivotally affixed to the third pivot bar aperture-area (145*c*).

Additionally, a fourth pivot bar aperture-area (146*d*) may be defined, in the second lower proximal bar, at or near the corner formed by the junction of the lateral end bar (134) and second lower proximal bar (144). The fourth lower pivot bar aperture-area (146*d*) may be located medial to the support bar (148), and the fourth lower pivot bar aperture-area (146*d*) may be coupled to the pivot bar side bar (165) at a pivot side bar connector area (51*d*); pivot side bar connector areas may have an aperture for receiving a bolt or other fastener. A fourth pivot bar aperture-area (145*d*) may be disposed in the second, upper proximal side bar (142) at a location in between support bar (136*b*) and support bar (136*a*). A proximal, lateral end (53*a*) of the pivot bar may be pivotally affixed to the first pivot bar aperture-area (145*a*).

Support bar (135*b*) may be coupled, such as coupled centrally, to the distal side bar (121) and the proximal side bar (141), such that the support bar (135*b*) may be located between the medial end bar (151) and support bar (135*a*). Referring to FIG. 6, lateral end bar (131), and distal side bar (121) may form a single, continuous piece; in other embodiments, lateral end bar (131) may be coupled to distal side bar (121). In the preferred embodiments, a side bar and an end bar may form a single, continuous "L-shaped" piece. Proximal side bar (141), lateral end bar (131), and distal side bar (121) may form one continuous piece, which may be referred to as the first upper frame (111). Referring to FIG. 1 a plurality of support rods (137*a*-137*g*) may lie orthogonal to the medial end bar (151), the support bar (135*a*), and the support bar (135*b*). Also referring to FIG. 1 a plurality of support rods (137*h*-137*n*) may lie orthogonal to the medial end bar (152), and support bars (136*b*) and (136*a*) Medial ends of the plurality of support rods (137*a*-137*g*) may be coupled to a superior surface of the medial end bar (151) and lateral ends of the plurality of support rods (137*a*-137*g*) may be coupled to a superior surface of the support bar (135*a*). The plurality of support rods (137*a*-137*g*) may also be coupled to the support bar (135*b*) where the plurality of support rods (137*a*-137*g*) may cross over the support bar (135*b*). Referring to FIG. 1 support rods (137*h*-137*n*) may be coupled similar the way support rods (137*a*-137*g*) are coupled to orthogonal bars. The support rods (137*a*-137*g*) may lie parallel to and be evenly spaced between the distal side bar (121) and the proximal side bar (141).

This specification may describe a single aperture area, a single hinge, or a single combination of structures. Since the bed base apparatus may have four corners; similar structures or combinations may be included at a corresponding area that is divided by a line of symmetry. It should be noted that in the preferred embodiments, the structure and function of a first corner of the apparatus, including aperture-areas for hinges, is the same or similar to the structure and function of a second corner, a third corner, and a fourth corner. Likewise, the first hinge body and its connections to bars is similar or identical to the second hinge body and its connections to bars.

The first lower frame (113) may be generally comprised of a distal side bar (123), a proximal side bar (143), a lateral end bar (133), a support bar (147), a first leg cover (210*a*), a first leg post (220*a*), a second leg cover (210*b*), and a second leg post (220*b*). The distal side bar (123) may be parallel to the proximal side bar (143). The support bar (147) may be positioned orthogonally to the distal side bar (123) and to the proximal side bar (143). The support bar (147) may be coupled at one end to the medial sides of the distal side bar (123) and on the opposing end to the proximal side bar (143). The support bar (147) may be coupled at one point near an end of the distal side bar (123) and at another point near an end of the proximal side bar (143); alternatively, the points at which the support bar (147) is coupled to the proximal side bar (143) and the distal side bar (123) may be medially inset from the lateral ends of the distal side bar (123) and the proximal side bar (143). A third pivot bar aperture-area (145*c*) may be defined in the distal side bar (122) and is not shown in FIG. 1 but is positioned adjacent and aligned with the distal, lateral end (53*c*) of the pivot bar, which may be located medially with respect to the point of coupling at the support bar (121). A fourth pivot bar aperture-area (145*d*) may be defined in the proximal side bar (142) medially to the location at which the support bar (136*a*) couples with the proximal side bar (142) and may be aligned with the third pivot bar aperture-area (145*c*). A first corner section of lateral end bar (133) may be coupled to the corresponding, opposing corner section of lateral end bar (131) by an elongated strap (133*a*); a second corner section of lateral end bar (133) may be coupled to the corresponding, opposing corner section of lateral end bar (131) by an elongated strap (134*d*). An elongated strap may be positioned at each corner of the frame. Elongated straps, such as elongated straps (134*c*; 134*d*) may be substantially thin and may be flexible. The elongated straps may be detachably coupled on one end to the upper frame and also may be detachably coupled on the opposing end to the lower frame. The elongated strap may be a single elastic band; the form of the strap may be such that the tension created with this single elastic band when the apparatus is opened from a closed configuration to an open configuration may help provide additional stability between the frames and may aid with alignment.

The first leg cover (210*a*) may be coupled to the lateral end bar (133) and the support bar (147) such that the first leg cover (210*a*) is disposed between the lateral end bar (133) and the support bar (147) and such that the first leg cover (210*a*) may be near the distal ends of the lateral end bar (133) and the support bar (147). The first leg post (220*a*) may be coupled to an inferior surface of the first leg cover (210*a*). The second leg cover (210*b*) may be coupled to the lateral end bar (133) and the support bar (147) such that the second leg cover (210*b*) may be disposed between the lateral end bar (133) and the support bar (147) and such that the second leg cover (210*b*) may be near the proximal ends of the lateral end bar (133) and the support bar (147). The second leg post (220*b*) may be coupled to an inferior surface of the second leg cover (210*b*). A first foot rest (230*a*) may be removably attached to the first leg post (220*a*), and a second foot rest (230*b*) may be removably attached to the second leg post 220*b*. A third aperture-area of the head section (300) may be disposed near a medial end of the distal side bar (123). A fourth aperture-area of the head section (300) may be disposed near the medial end of the proximal side bar (143).

The first pivot bar (155) may be generally comprised of a pivot support bar (158) which may be a rod extending longitudinally having a first proximal lateral end and a first distal lateral end, wherein the first lateral end may have an aperture-area (53*a*) for receiving a bolt, wherein the second lateral end may have an aperture-area (53*b*) for receiving a bolt.

The pivot support bar (158) may further include a) a distal vertical bar (153) coupled, by a superior end of the distal vertical bar, to the first distal lateral end of pivot support bar (158), and b) a proximal vertical bar (154) which may be coupled, by a superior end of the proximal vertical bar, to the first proximal lateral end. The inferior end of the proximal vertical bar may include a hinge, which may be L-shaped, for coupling with the nearest proximal side bar; the inferior end of the distal vertical bar may include a hinge, which may be L-shaped, for coupling with the nearest distal side bar. The distal vertical bar (153) may be coupled by a superior end to a distal end of the pivot support bar (158). A first distal vertical bar hinge (51*a*) may be coupled to a distal face of an inferior end of the distal vertical bar (153). The first distal vertical bar hinge (51*a*) may extend from distal vertical bar (153) such that when the first distal vertical bar hinge (51*a*) may be coupled to the distal vertical bar (153), a portion of the first distal vertical bar hinge (51*a*) may extend laterally from the inferior end of the distal vertical bar (153) so as to form an angle, such as a right angle, with the distal vertical bar (153). (In some embodiments, the first distal vertical bar hinge (51*a*) may not extend from the distal vertical bar (153).) Distal vertical bar hinge (51*a*) may be pivotally attached to the first pivot bar aperture-area (146*a*) of the first lower frame (113). FIG. 6 shows an exploded view and does not show the actual point of contact for when the distal vertical bar hinge (51*a*) is pivotally attached to the first lower frame (113); however, FIG. 1 and FIG. 2 depict distal vertical bar hinge (51*a*) in a pivotally attached configuration. The first proximal vertical bar (154) may be coupled by a superior end to a proximal end of the pivot support bar (158). The first proximal vertical bar hinge (51*b*) may be coupled to a proximal face of an inferior end of the proximal vertical bar (154). The proximal vertical bar hinge (51*b*) may be substantially L-shaped such that when it is coupled to the proximal vertical bar (154) a portion of the proximal vertical bar hinge (51*b*) may extend laterally from the inferior end of the proximal vertical bar (154) so as to form a right angle with the proximal vertical bar (154). This portion of the proximal vertical bar hinge (51*b*) may pivotally attach to the second pivot bar aperture-area (146*b*) of the first lower frame (113). Proximal vertical bar hinge (51*b*) may also not necessarily extend in an L-shaped manner but may be affixed to the proximal vertical bar (154). (The distal end of the pivot support bar (158) may pivotally attach to the first pivot bar aperture-area (145*a*) of the first upper frame (111) and the proximal end of the pivot support bar (158) may pivotally attach to the second pivot bar aperture-area (145*b*) of the first upper frame (111).). Based on FIGS. 1, 2, and 6, one skilled in the art would know that pivot bar (160) may be arranged and configured similarly to pivot bar (155), except that pivot bar (160) connects to elements of the foot section (302).

A first pivot bar stop (240*a*) and a second pivot bar stop (240*b*) may be coupled to the distal side bar (123) and the proximal side bar (143) respectively. The first pivot bar stop (240*a*) may be coupled to the distal side bar (123) medially to the third pivot bar aperture-area (145*c*) and the second pivot bar stop (240*b*) may be coupled to the proximal side bar (143) medially to the fourth pivot bar aperture-area (145*d*) so as to be aligned with the first pivot bar stop (240*a*). With respect to the rotation of the proximate face of the proximate vertical bar (154) in relation to the proximate side bar (143), the lateral end bar (133), the first pivot bar stop (240*a*), and the second pivot bar stop (240*b*) may limit the rotation of the first pivot bar (155) from moving to substantially a nine-o-clock position, when the bed base apparatus is in an open configuration, from a substantially a twelve-o-clock positions or vertical aligned positioned, which is the position of the pivot bar when the bed base apparatus is in an open position. The nine-o-clock position limit may be an eleven-o-clock position limit, or even an eleven-forty-five o'clock position, or even the position of the hour hand at 11:59; for the first pivot bar (155) the o'clock position refers to the position of the pivot support bar as if the pivot support bar was located at the tip of an hour hand of a clock as viewed from the distal side bar (123). For purposes of determining the position of the second pivot bar (160), one would use the same o'clock positions; however, the view would be from the proximal side bar (144); since in the preferred embodiments both pivot bars fold inwardly towards the central support bar and away from the closest end bars. When the apparatus is in a closed position or partly closed position such as laid horizontally to the ground, the first pivot bar (155) may be in the nine-o-clock position so that the proximal vertical bar (154) may be parallel to the proximal side bar (143), and when the first pivot bar (155) is in the twelve-o-clock position, the proximal vertical bar (154) may be orthogonal to the proximal side bar (143).

The foot section (302) may be generally comprised of a second upper frame (112), a second lower frame (114), and a second pivot bar (160). The second upper frame (112) may be comprised of a distal side bar (122), a proximal side bar (142), a lateral end bar (132), a medial end bar (152), one or more support bars (136), and a plurality of support rods (138*a*-138*g*, only 138*a* is labeled but 138*b*-138*g* are rods which are aligned in the same direction as 138*a*). The distal side bar (122) may be parallel to the proximal side bar (142). The medial end bar (152) and one or more support bars (136), preferably at least support bar (136*a*) and support bar (136*b*), may be orthogonal to both the distal side bar (122) and the proximal side bar (142). The medial end bar (152) and the one or more support bars (136) may be coupled to medial sides of the distal side bar (122) and the proximal side bar (142). The medial end bar (152) may be coupled to the distal side bar (122) at, near, or far from the lateral end of the distal side bar (122) and also may be coupled to the proximal side bar (142) at, near, or far from the lateral end of the proximal side bar (142), and in the preferred embodiments the medial end bar (152) is coupled at a position that is slightly laterally inset from the medial ends of the medial end bar (152) and the distal side bar (122) so as to define a first area and a second area. The first area may further define a first aperture-area of the foot section (302), and the second area may further define a second aperture-area of the foot section (302). Support bar (136*a*) may be coupled near lateral ends, but slightly medially inset from the lateral ends of the distal side bar (122) and the proximal side bar (142). A first pivot bar aperture-area (146*a*) may be defined by the distal side bar (122) medially to the coupling of the support bar (136*a*). A second pivot bar aperture-area (146*b*) may be defined in the proximal side bar (142) medially to the coupling of the support bar (136*b*) and aligned with the first pivot bar aperture-area (146*a*). Support bar (136*b*) may be coupled centrally to the distal side bar (122) and the proximal side bar (142), such that the support bar (136*b*) may be located between the medial end bar (152) and support bar (136*a*). Lateral end bar (132) may be coupled to the lateral ends of the distal side bar (122) and the proximal side bar (142) by elongated straps (134*a*) and (134*b*). A plurality of support rods (138) may be disposed orthogonal to the medial end bar (152), the support bar (136*a*), and the support bar (136*b*). Medial ends of the plurality of support rods (138) may be coupled to a superior surface of the medial end bar (152) and lateral ends of the plurality of support rods (138) may be coupled to a superior surface of the support bar (136*a*). The plurality of support rods (138) may also be coupled to the support bar (136*b*) where the plurality of support rods (138) may cross over the support bar (136*b*). The support rods (138) may lie parallel to and be evenly spaced between the distal side bar (122) and the proximal side bar (142).

The second lower frame (114) may be generally comprised of a distal side bar (124), a proximal side bar (144), a lateral end bar (134), a support bar (148), a third leg cover (210*c*), a third leg post (220*c*), a fourth leg cover (210*d*), and a fourth leg post (220*d*). The second distal side bar (124) of the second lower frame may be parallel to the second proximal side bar (144) of the second lower frame. The support bar (148) may be positioned orthogonally to the distal side bar (124) and to the proximal side bar (144). The support bar (148) may be coupled to medial sides of the distal side bar (124) and the proximal side bar (144). The support bar (148) may be coupled near the lateral end bar (134) and slightly medially inset from the lateral ends of the distal side bar (124) and the proximal side bar (144). A third pivot bar aperture-area (146*c*) may be defined in the distal side bar (124) medially to the coupling of the support bar (148). A fourth pivot bar aperture-area (146*d*) may be defined in the proximal side bar (144) medially to the coupling of the support bar (148) and aligned with the third pivot bar aperture-area (146*c*). Lateral end bar (134) may be coupled to the lateral ends of the distal side bar (124) and the proximal side bar (144) by an elongated strap at each corner. The third leg cover (210*c*) may be coupled to the lateral end bar (134) and the support bar (148) such that the third leg cover (210*c*) may be disposed between the lateral end bar (134) and the support bar (148) and such that the third leg cover (210*c*) may be near the distal ends of the lateral end bar (134) and the support bar (148). The third leg post (220*c*) may be coupled to an inferior surface of the third leg cover (210*c*). The fourth leg cover (210*d*) may be coupled to the lateral end bar (134) and the support bar (148) such that the fourth leg cover (210*d*) may be disposed between the lateral end bar (134) and the support bar (148) and such that the fourth leg cover (210*d*) may be near the proximal ends of the lateral end bar (134) and the support bar (148). The fourth leg post (220*d*) may be coupled to an inferior surface of the fourth leg cover (210*d*). A third leg rest (220*c*) may be removably attached to the third leg post (220*c*) and a second leg rest (230*d*) may be removably attached to the fourth leg post (220*d*). A third aperture-area (191) of the foot section (302) may be disposed near a medial end of the distal side bar (124). A fourth aperture-area (197) of the foot section (302) may be disposed near the medial end of the proximal side bar (144).

The second pivot bar (160) may be generally comprised of a support bar (166), a distal vertical bar (164), a proximal vertical bar (165), a second proximal vertical bar hinge (51*c*) and a second distal vertical bar hinge (51*d*). The distal vertical bar (164) may be coupled by a superior end to a distal end of the support bar (166). The second proximal vertical bar hinge (51*c*) may be coupled to a distal face of an inferior end of the distal vertical bar (164). The second proximal vertical bar hinge (51*c*) may be L-shaped such that when it is coupled to the distal vertical bar (164) a portion of the second proximal vertical bar hinge (51*c*) may extend laterally from the inferior end of the distal vertical bar (164) so as to form a right angle with the distal vertical bar (164). As described for hinge (51*a*), hinge (51*c*) may not necessarily extend from distal vertical bar (164) in the lateral direction. Second proximal vertical bar hinge (51*c*) may be pivotally attached to the third pivot bar aperture-area (146*c*) of the second lower frame (114). The proximal vertical bar (165) may be coupled by a superior end to a proximal end of the support bar (166). The second proximal vertical bar hinge (51*d*) may be coupled to an inward-facing face of an inferior end of the proximal vertical bar (165). The second proximal vertical bar hinge (51*d*) may be L-shaped such that when it is coupled to the proximal vertical bar (165) a portion of the second hinge (163) may extend laterally from the inferior end of the proximal vertical bar (165) so as to form a right angle with the proximal vertical bar (165); however, the second proximal vertical bar hinge (51*d*) may not necessarily be L-shaped. The second proximal vertical bar hinge (51*d*) may pivotally attach to the fourth pivot bar aperture-area (146*d*) of the second lower frame (114). The proximal, lateral end (53*d*) of the support bar (166) may be pivotally attached to the first pivot bar aperture-area (146*a*) of the second upper frame (112) and the proximal end of the support bar (166) may be pivotally attached to the second pivot bar aperture-area (146*b*) of the second upper frame (112).

A first pivot bar stop (242*a*) and a second pivot bar stop (242*b*) may be coupled to the distal side bar (124) and the proximal side bar (144) respectively. The first pivot bar stop (242*a*) may be coupled to the distal side bar (124) medially to the third pivot bar aperture-area (146*c*) and the second pivot bar stop (242*b*) may be coupled to the proximal side bar (144) medially to the fourth pivot bar aperture-area (146*d*) so as to be aligned with the first pivot bar stop (242*a*). With respect to the rotation of the proximate face of the proximate vertical bar (165) in relation to the proximate side bar (144), the lateral end bar (134), the first pivot bar stop (242*a*), and the second pivot bar stop (242*b*) may limit the rotation of the second pivot bar (160) so as to rotate from the twelve-o-clock position to no more than the three-o-clock, such that when the second pivot bar (160) is in the twelve-o-clock position, the proximal vertical bar (165) may be orthogonal to the proximal side bar (144), and when the second pivot bar (160) is in the three-o-clock position, the proximal vertical bar (165) may be parallel to the proximal side bar (144).

In the preferred embodiments, pivot bar stops are positioned medially with respect to the position of the side bars of the pivot bar stops. In the preferred embodiments, when closing the folding bed base apparatus, the pivot support bar (158) is rotated towards the lateral end bar (131). In some embodiments, when the bed base apparatus is in an open position, the pivot support bar (158) is substantially parallel to support bar (135*b*) and provides support to the first upper frame. During the closing process, the pivot support bar (158), as shown in FIG. 6, may be rotated along the pivot point where pivot side bar connector area (51*a*) is coupled to the first lower pivot bar aperture-area (146*a*) so that the main length of distal vertical bar (153) is substantially parallel with distal side bar (123). In some embodiments, the pivot support bars may rotate inwardly toward central bar (204) away from the nearest end bars during the process of closing the bed base apparatus, but in the preferred embodiments the pivot support bars are rotated towards the nearest end bar when the bed base apparatus is being closed. The proximal, lateral end (53*b*) of the pivot support bar (158) may similarly rotate towards the closest end bar during the process of being closed, which may be substantially a 90 degree rotation away from the closest pivot bar stop; a distal, lateral end (53*c*) of the pivot bar and a proximal, lateral end (53*d*) of the pivot bar may be rotated towards the nearest end bar, such as lateral end bar (134), during the process of being closed, with the coupling of pivot side bar connector area (51*c*) and third pivot bar aperture-area (146*c*) acting as a pivot point or a hinge and with the coupling of (51*d*) and (242*b*) also acting as a pivot point. Bolts may be placed through any aperture-area to allow the bolt-aperture-area to function as a hinge, pivot point, or rotational point.

FIGS. 1 and 2 also illustrate elastic bands (250*a-d*). The elastic bands (250*a-d*) may couple a corner of the upper frame to the corresponding corner of the lower frame. For example, a first elastic band (250*a*) may be secured around the elongated straps (133*a*) and (134*a*), a second elastic band (250*b*) may be secured around the curved sections (133*b*) and (134*b*), a third elastic band (250*c*) may be secured around the curved sections (133*c*) and (134*c*), and a fourth elastic band (250*d*) may be secured around the curved sections (133*d*) and (134*d*). The curved sections may stand alone as elastic bands.

Both the first upper frame (111) and the first lower frame (113) of the head section (300) and both the second upper frame (112) and the second lower frame (114) of the foot section (302) may be pivotally attached to the central frame assembly (110). The first upper frame (111) may be pivotally attached both to the first upper horizontal member (243) and to the second upper horizontal member (244). The second upper frame (112) may be pivotally attached both to the first upper horizontal member (243) and to the second upper horizontal member (244). The first lower frame (113) and the second lower frame (114) may be pivotally attached both to the first lower horizontal member (245) and to the second lower horizontal member (246).

The first upper frame (111) may be pivotally attached, at aperture-area (1911), to the first hinge aperture-area (171) of the first upper horizontal member (243) and to the third hinge aperture-area (181) of the second upper horizontal member (244) in the manner described below. The second aperture-area (192) of the first upper frame may be pivotally attached to the first hinge aperture-area (181). The first upper frame (111) may be pivotally attached in the above described manner by nut and bolt or by any other method of pivotal attachment known in the art.

The first lower frame (113) may be pivotally attached to the fifth hinge aperture-area (173) of the first lower horizontal member (245) and to the seventh hinge aperture-area (183) of the second lower horizontal member (246). The fourth aperture-area (196) may be pivotally attached to the seventh hinge aperture-area (183). The first lower frame (113) may be pivotally attached in the above described manner by nut and bolt or by any other method of pivotal attachment known in the art.

The second upper frame (112) may be pivotally attached to the second hinge aperture-area (172) of the first upper horizontal member (243) and to the fourth hinge aperture-area (182) of the second upper horizontal member (244) in the manner described below: the first aperture-area (1910) of the second upper frame (112) may be pivotally attached to the second hinge aperture-area (172). The second aperture-area (193) of the second upper frame (112) may be pivotally attached to the fourth hinge aperture-area (182). The second upper frame (112) may be pivotally attached in the above described manner by nut and bolt, or by any other method of pivotal attachment known in the art.

The second lower frame (114) may be pivotally attached to the sixth hinge aperture-area (174) of the first lower horizontal member (245) and to the eighth hinge aperture-area (184) of the second lower horizontal member (246) in the manner described below: the third aperture-area (191) of the second lower frame (114) may be pivotally attached to the sixth hinge aperture-area (174). The fourth aperture-area (197) of the second lower frame (114) may be pivotally attached to the eighth hinge aperture-area (184). The second lower frame (114) may be pivotally attached in the above described manner by nut and bolt, or by any other method of pivotal attachment known in the art.

A fabric covering may be designed to easily slip over the folding bed base apparatus (100) when in the unfolded configuration. The fabric covering may be designed to fold with the folding bed base apparatus (100) into the folded configuration. The fabric covering may be made of a durable material so as to frictionally-obstruct the fabric covering from ripping when the folding bed base apparatus (100) is folded and unfolded between the folded configuration and the unfolded configuration. In addition, a durable tarp may be designed to slip over the top of the folding bed base apparatus (100) when in the folded configuration so as to protect the folding bed base apparatus (100) and to keep the fabric covering clean while the folding bed base apparatus (100) is in storage or in transportation.

Figure 3:
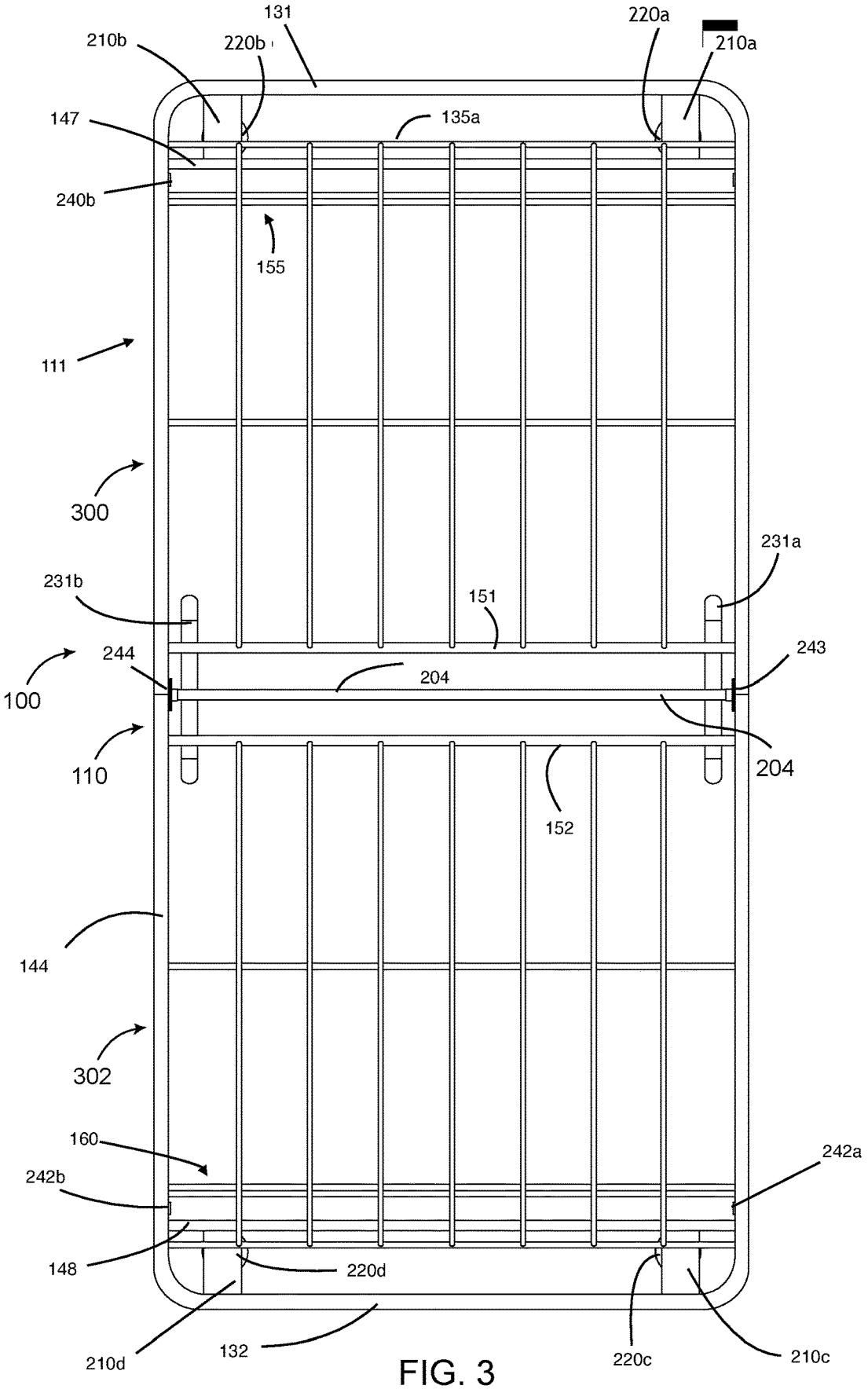
FIG. 3 illustrates a top plan view of the folding bed base apparatus of FIGS. 1 and 2.
Figure 4:
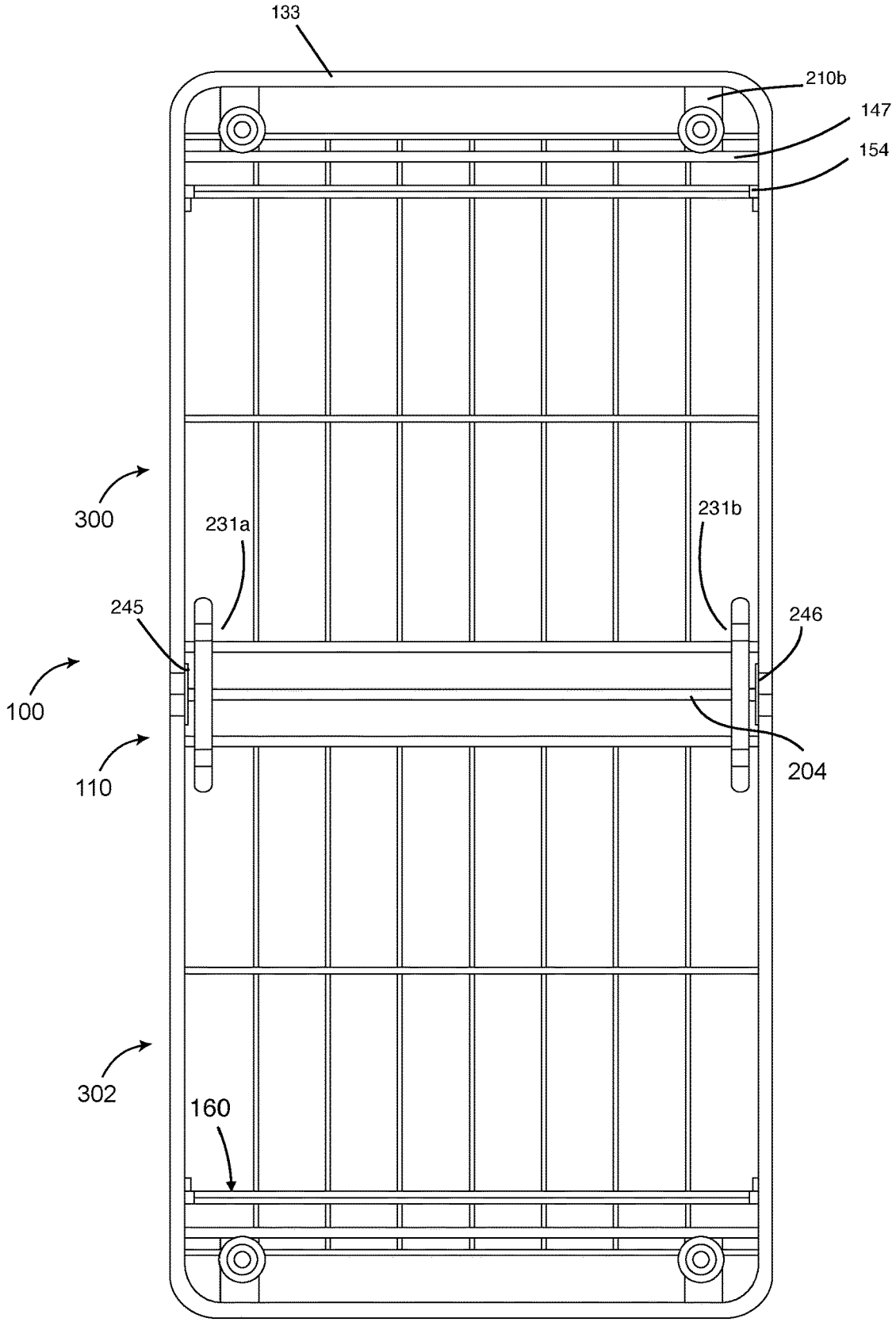
FIG. 4 illustrates a bottom plan view of the folding bed base apparatus of FIGS. 1-3.

FIGS. 3 and 4 illustrate a top plan view and a bottom plan view respectively of the folding bed base apparatus (100). These figures further illustrate that the central frame assembly (110) may be the center of the folding bed base apparatus (100) upon which the first upper frame (111), the second upper frame (112), the first lower frame (113), and the second lower frame (114) may be attached. The figures also further illustrate the symmetry, in some embodiments, of the head section (300) and the foot section (302) across the central frame assembly (110).

Figure 5:
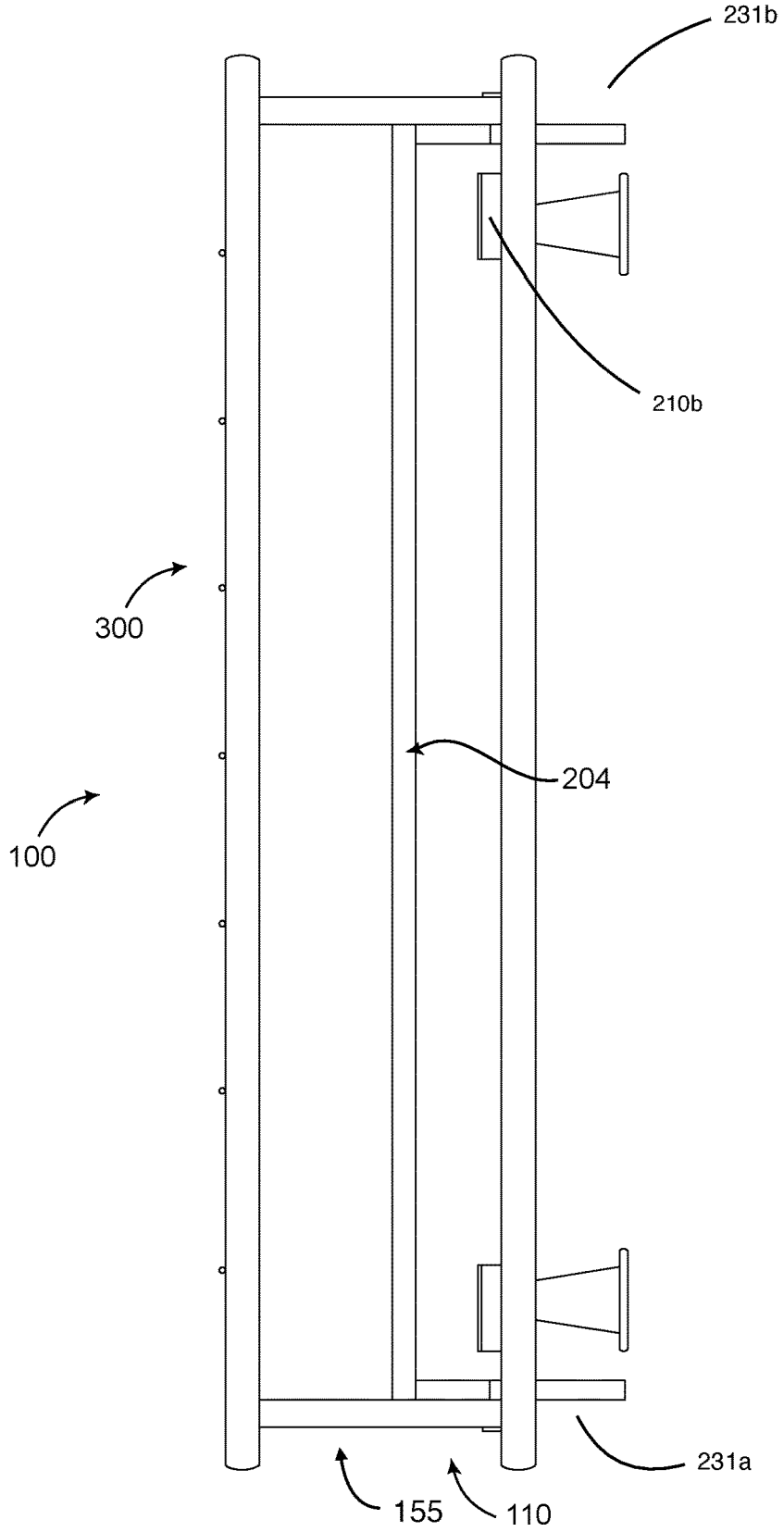
FIG. 5 illustrates a front end plan view of the folding bed base apparatus of FIGS. 1-4; although not shown a back end plan view of the folding bed base apparatus of FIGS. 1-4 would be structurally the same as FIG. 5; however, the actual elements of the drawing would correspond with the elements which are viewable from the back end.

FIG. 5 illustrates a bottom end plan view of the folding bed base apparatus (100) while the folding bed base apparatus (100) is in the unfolded configuration. This figure illustrates the positioning of the central frame assembly (110) showing that the central support bar (204) is positioned superiorly to the lateral end bar (134) of the second lower frame (114) and inferiorly to the lateral end bar (132) of the second upper frame (112) when the folding bed base apparatus (100) is in the unfolded configuration.

FIG. 6 illustrates all of the separate sections of the folding bed base apparatus (100) in an exploded perspective view. The figure illustrates the central frame assembly (110), the first upper frame (111), the first lower frame (113), the first pivot bar (155), the second upper frame (112), the second lower frame (114), the second pivot bar (160), the foot rests (230*a-d*), and the U-shaped foot rests (231*a*) and (231*b*).

Figure 7:
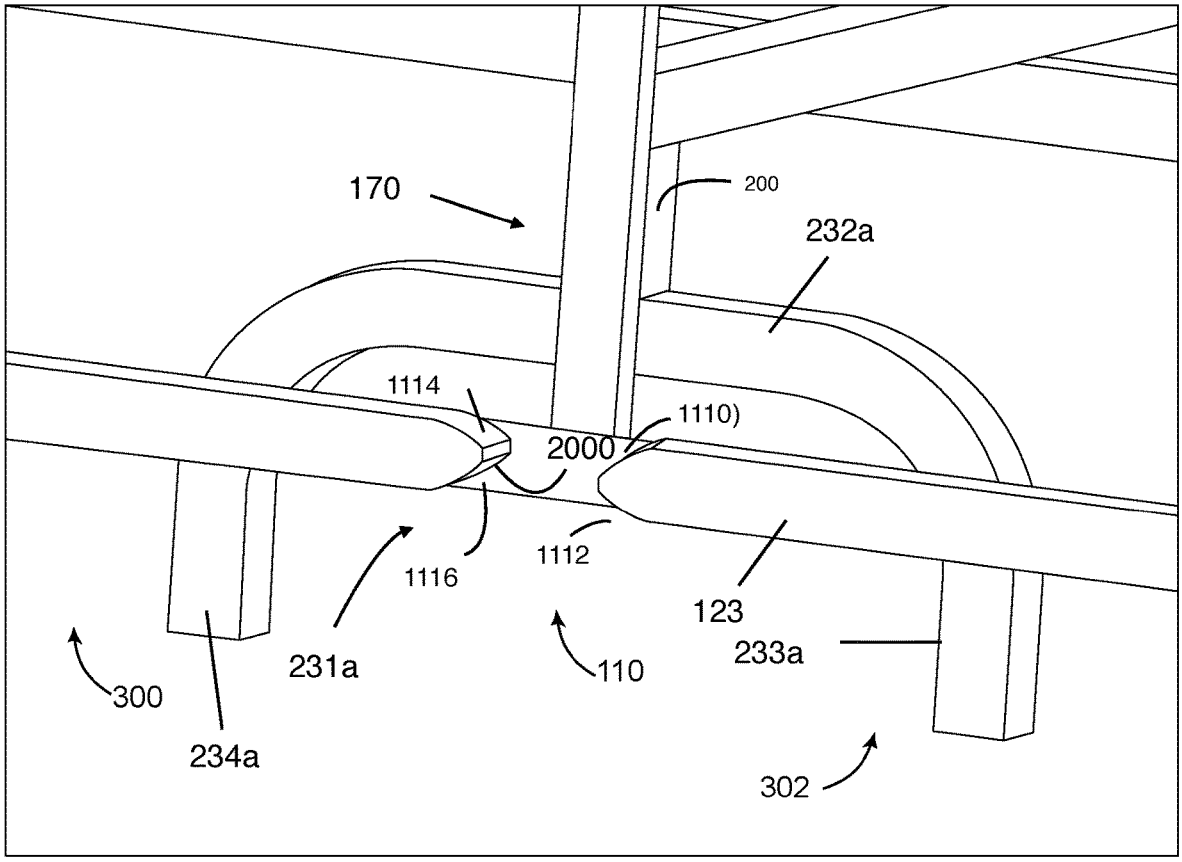
FIG. 7 illustrates a zoomed in perspective view of an arched leg of the folding bed base apparatus of FIGS. 1-6 with the folding bed base apparatus in an unfolded bed position.

FIG. 7 illustrates a zoomed in perspective view of the first U-shaped foot rest (231*a*). The FIG. 7 shows the horizontal section (232*a*) coupled to the first medial leg support (200). As mentioned above, the horizontal section (232*a*) may be removably attached to the second medial leg support (200), or alternatively, the horizontal section (232*b*) may be permanently coupled to the first medial leg support (200). The first medial leg support (200) may be medially-positioned relative to the first distal side bar (123). Furthermore, the first foot (233*a*) of the first U-shaped foot rest (231*a*) may extend into the head section (300) of the folding bed base apparatus (100) and the second foot (234*a*) of the U-shaped foot rest (231*b*) may extend into the foot section (302) of the folding bed base apparatus (100). It should be noted that the first U-shaped foot rest (231*a*) may be identical, or substantially similar, to the second U-shaped foot rest (231*b*) in size and shape and attached in a similar manner to the first medial leg support (200).

FIG. 7 also depicts four beveled edges; the beveled edges of FIG. 7 are as follows: an upper surface including a beveled edge (1110) of the medial-facing end of the distal side bar of the first upper frame; a lower surface including a beveled edge (1112) of medial-facing end of the distal side bar of the first upper frame; an upper surface (1114) including a beveled edge of a medial-facing end of the distal side bar of the second upper frame; a lower beveled edge (1116) of the medial-facing end of the distal side bar of the second upper frame; in some embodiments a flat face (2000) may be formed that intersects, on the lower edge of the flat face, a lower beveled edge and also intersects, on the upper edge of the flat face, an upper beveled edge; the flat face may be a certain height that is a percentage of the height of the side bar, such as between 10% and 20%, 20% and 30%, 30% and 40%, 50% and 60%, 70% and 80%, and 25% and 40%.

FIG. 8 shows a top perspective view of the folding bed base apparatus (100) in a partially folded configuration with the head section (300) unfolded and the foot section (302) folded. This figure illustrates how the folding bed base apparatus (100) may become more compact when in the folded configuration. First, because the seventh hinge aperture-area (183) and the eighth hinge aperture-area (184) may be spaced further apart than the third hinge aperture-area (181) and the fourth hinge aperture-area (182), and because the fifth hinge aperture-area (173) and the sixth hinge aperture-area (174) may also be spaced further apart than the first hinge aperture-area (171) and the second hinge aperture-area (172), and because the hinge aperture-areas (171-174) may be aligned with the hinge aperture-areas (181-184) respectively, the second upper frame (112) and the second lower frame (114) may be parallel and may be come into contact with each other, which may leave no or little in-between space, when the foot section (302) is in the folded position. Second pivot bar (160) is shown in an orthogonal position relative to the second distal end bar (124). The first pivot bar (155) may be pivoted to a position that is parallel with the distal side bar (123). FIG. 8 illustrates the position of a method of folding the bed base, in which one half, here head section, is folded. A next step, although not shown, would be to fold the foot section. During the step of folding the foot section, the second pivot bar (160) pivots by rotating near the closes end bar, so as to fold within the second upper frame (112) such that the distal vertical bar (164) and the proximal vertical bar (165) may be rotated substantially 90 degrees away from the central support bar and the main length of the side bars of the pivot bar (160) may become parallel to and, in some embodiments, in contact with the medial faces of the distal side bar (122) and the proximal side bar (142) respectively. Generally, as a pivot bar is rotated from the vertical position, the upper frame which is connected to the pivot bar may be lowered and brought closer to the corresponding lower frame.

FIG. 9 is a perspective view of the folding bed base apparatus (100) in the folded configuration with both the head section (300) and the foot section (302) folded upward. FIG. 9 illustrates that the first U-shaped foot rest (231*a*) and the second U-shaped foot rest (231*b*) may be positioned to allow the folded folding bed base apparatus (100) to stand upright while in the folded position. The first U-shaped foot rest (231*a*) and the second U-shaped foot rest (231*b*), by resting the feet on the ground, may provide a steady and secure base to support the folding bed base apparatus (100) in the upright position. This closed configuration for the apparatus may allow the folded folding bed base apparatus (100) to be placed in a closet, against a wall, in a garage, in a shed, etc. with less of a likelihood that the folding bed base apparatus 100 will tip over and break items or cause injury. The second lower horizontal member (246) is shown.

Figure 10:
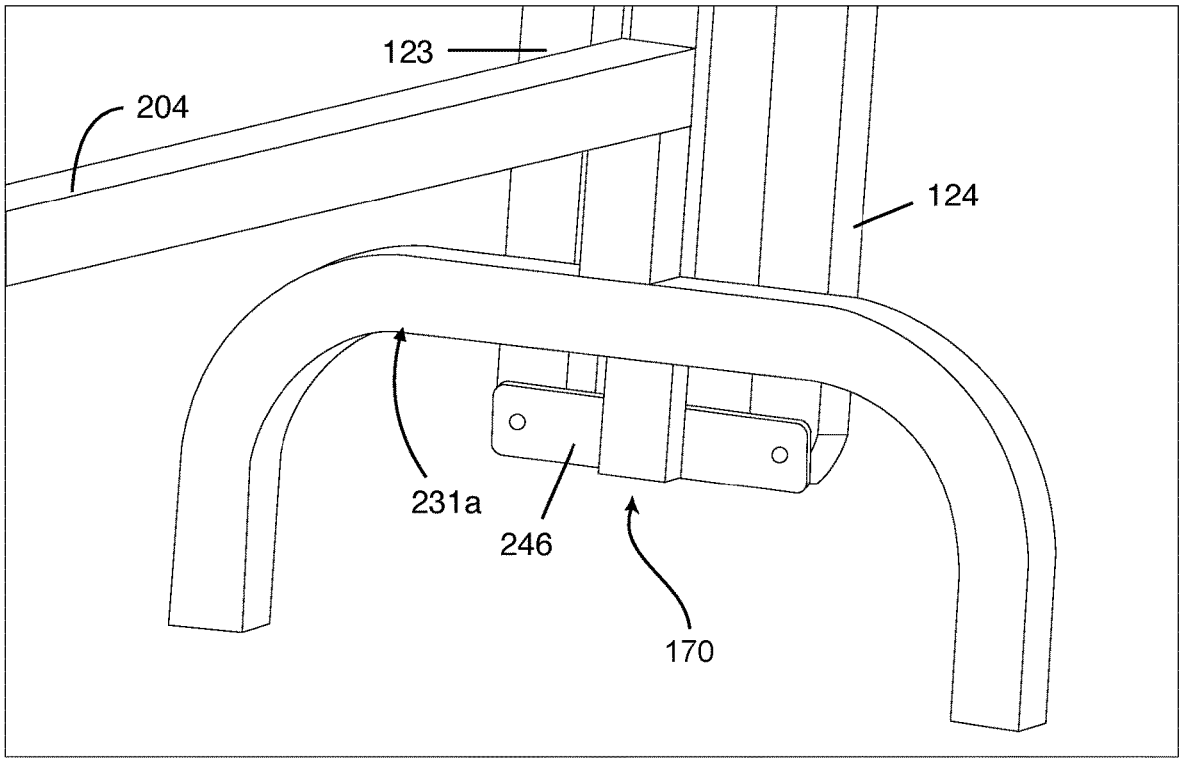
FIG. 10 illustrates a zoomed-in perspective view of an arched leg of the folding bed base apparatus of FIGS. 1-6, 8 and 9 with the folding bed base apparatus in the completely folded storage position.

FIG. 10 illustrates a zoomed in perspective view of the first U-shaped foot rest (231*a*) while the folding bed base apparatus (100) is in the folded configuration. As can be seen from the figure, the U-shaped foot rest (231*a*) provides a wider base when the folding bed base apparatus (100) is in the folded configuration than would otherwise be available for the folding bed base apparatus (100) to rest upon. This wide base may frictionally-obstruct the folding bed base apparatus (100) from easily wobbling or tipping over when stored in the upright position. If the user would like to fold the folding bed base apparatus (100) and store the folding bed base apparatus (100) lying down, then the first and second U-shaped leg rests (231*a*) and (231*b*) may be removed to allow the folded folding bed base apparatus (100) to lay flat.

Figure 11:
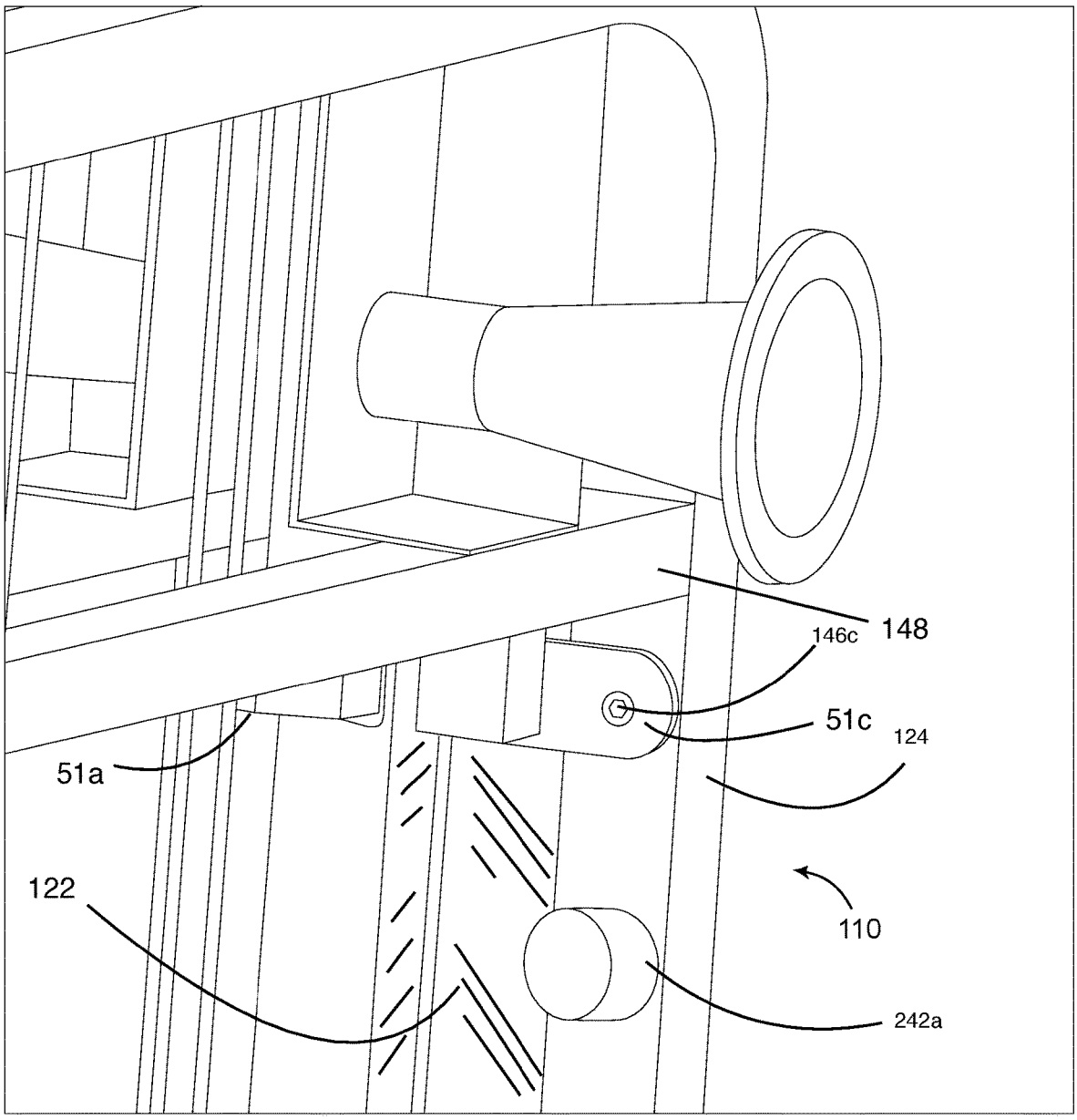
FIG. 11 illustrates a zoomed-in perspective view of a foot rest of the folding bed base apparatus of FIGS. 1-6, 8 and 9 with the folding bed base apparatus in the completely folded storage position.

FIG. 11 illustrates a zoomed-in perspective view of the distal lateral corner of the second lower frame (114) while the folding bed base apparatus (100) is in the folded configuration. This figure further illustrates the positioning of the first pivot bar stop (242*a*). The first pivot bar stop (242*a*) may be coupled to the distal side bar (124) medially to the third pivot bar aperture-area (146*c*) such that in a step of the method for opening the apparatus, the second pivot bar (160) may be rotated, from being parallel to the proximal side bar (144), counterclockwise to the twelve-o-clock position. The second pivot bar stop (242*a*) may then help to frictionally-obstruct the second pivot bar (160) from rotating substantially past this twelve-o-clock position and towards the central support bar. Essentially, as described above, the pivot bar stops (240*a*), (240*b*), (242*a*), and (242*b*) may keep the first pivot bar (155) and the second pivot bar (160) in the twelve-o-clock positions while the folding bed base apparatus (100) is in the folded configuration. This configuration may in turn frictionally-obstruct the folding bed base apparatus (100) from continuing to fold past the unfolded configuration.

Figure 12:
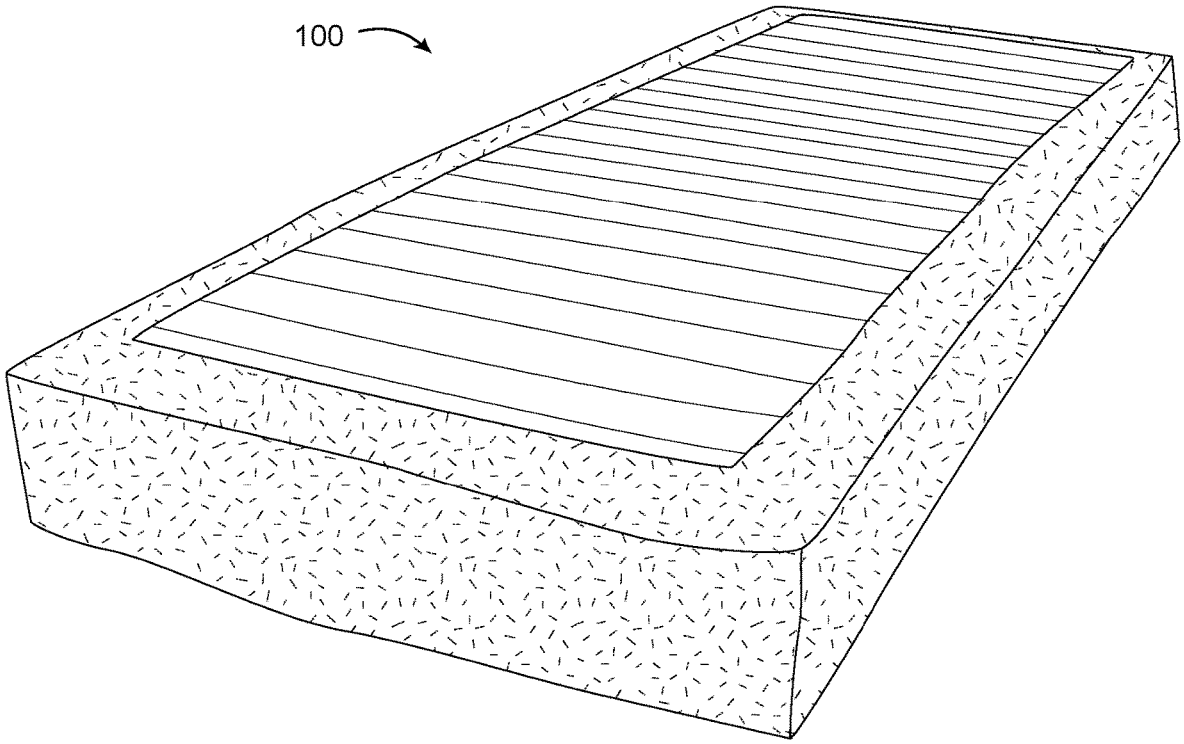
FIG. 12 illustrates an unfolded apparatus surrounded by a cover.

FIG. 12 depicts folding bed base apparatus (100) being disposed within a cover; the cover may be zippable and removable.

Figure 13:
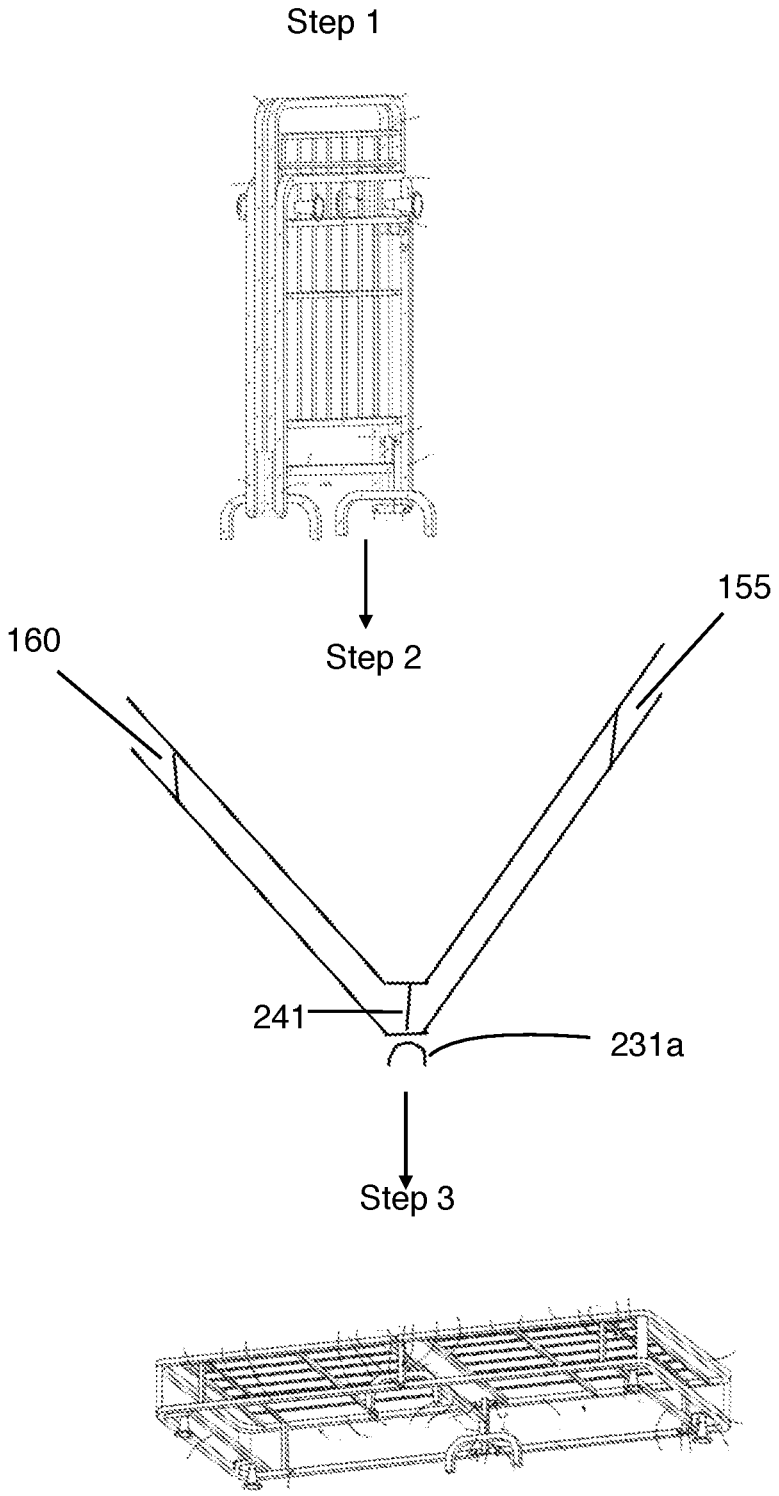
FIG. 13 illustrates a method of using the apparatus.

FIG. 13 depicts a method for using a folding bed base apparatus (100) including providing a folding bed base apparatus (100) which may include a first hinge body (170), in which the first hinge body (170) may include a first upper horizontal member (243) and a first lower horizontal member (245); the apparatus may include a second hinge body (180), in which the second hinge body (180) may include a second upper horizontal member (244) and a second lower horizontal member (246); the central frame assembly (110) may further include a central support bar (204), in which a distal end of the central support bar (204) may be coupled to the first hinge body (170) and a proximal end of the central support bar (204) may be coupled to the second hinge body (180); in which the central support bar (204) may be horizontally-aligned.

Providing the folding bed base apparatus (100) may further include providing a head section (300) which may include: a first upper frame (111), in which the first upper frame (111) may be pivotally attached to the first upper horizontal member (243) and to the second upper horizontal member (244); in which the first upper frame (111) may be vertically-aligned. The head section (300) may further include a first lower frame (113), in which the first lower frame (113) may be pivotally attached to the first lower horizontal member (255) and to the second lower horizontal member (256); in which the first lower frame (113) may be vertically-aligned. The head section (300) may further include a first pivot bar (155), in which the first pivot bar (155) may be pivotally attached to the first lower frame (113); the head section (300) may further include a first pivot bar stop (240*a*) and a second pivot bar stop (240*b*), in which the first pivot bar, the first pivot bar stop, and the second pivot bar stop frictionally-obstruct the head section from continuing to pivot in a counter-clockwise direction past the unfolded position.

The folding bed base apparatus (100) may further include a foot section (302). The foot section (302) may include: a second upper frame, in which the second upper frame may be pivotally attached to the first upper horizontal member and to the second horizontal member. The second upper frame may be vertically aligned. The second upper frame may include a second lower frame, in which the second lower frame may be pivotally attached to the first lower horizontal member and to the second lower horizontal member; in which the second upper frame may be vertically-aligned. The foot section may further include a second pivot bar, in which the second pivot bar may be pivotally attached to the second lower frame. The foot section may further include a third pivot bar stop and a fourth pivot bar stop, in which the second pivot bar, the third pivot bar stop; and the fourth pivot bar stop frictionally-obstruct the foot section from pivoting in a clockwise direction past the unfolded position; wherein the first hinge body further comprises a first medial leg support; wherein the second hinge body further comprises a second medial leg support; providing the bed-base apparatus may include providing the bed-base apparatus with the other features and elements as described in the specification, the claims, and the drawings. Step 1 of FIG. 13 shows the bed base where the upper frames and lower frames are substantially vertically aligned.

In some embodiments, a method of using a folding bed base apparatus that has been folded and aligned vertically, as shown in FIG. 9, may include:

rotating the first upper frame from being vertically-aligned to being horizontally-aligned while almost simultaneously rotating the first pivot bar from being substantially horizontally-aligned to being substantially vertically-aligned wherein the relative positions to each other of the first pivot bar, the first pivot bar stop, and the second pivot bar stop when the pivot bar is vertically-aligned is such that the first pivot bar is frictionally obstructed by the first pivot bar stop and frictionally obstructed by the second pivot bar stop from a) rotating, in the direction away from the lateral end bar (133), greater than 15 degrees past being vertically-aligned;

rotating the first lower frame from being vertically-aligned to being horizontally-aligned;

rotating the second upper frame from being vertically-aligned to being horizontally-aligned wherein the step of rotating the second upper frame from being vertically-aligned to being horizontally aligned;

rotating, almost simultaneously with respect to the step of rotating the second upper frame, the first pivot bar from being substantially horizontally-aligned to being substantially vertically-aligned wherein the relative positions to each other of the first pivot bar, the first pivot bar stop, and the second pivot bar stop when the pivot bar is vertically-aligned is such that the first pivot bar is frictionally obstructed by the first pivot bar stop and frictionally obstructed by the second pivot bar stop from rotating, in the direction away from the lateral end bar (133), greater than 15 degrees past being vertically-aligned and; rotating the second lower frame from being vertically-aligned to being horizontally-aligned;

rotating the first pivot bar from being horizontally-aligned to being vertically-aligned;

rotating the second pivot bar from being horizontally-aligned to being vertically-aligned;

placing a mattress having a mass so that the mass of mattress substantially rests on the first upper frame and on the second upper frame. Step 2 of FIG. 13 shows the bed base in a transition stage between being closed and being opened; as stated above, rotating the pivot bars from being horizontally aligned to being vertically aligned may include rotating the pivot bars to be slanted, as shown at pivot bar (155) and pivot bar (160).

Another method for using a folded bed base apparatus, may further comprise the step of rotating the second upper frame from being vertically-aligned to being horizontally-aligned wherein the step of rotating the second upper frame from being vertically-aligned to being horizontally aligned further comprises contacting both the first U-shaped foot rest and a second U-shaped foot rest to the ground, as depicted in FIG. 9 and Step 3 of FIG. 13. In Step 3 of FIG. 13, the upper frames and lower frames have been moved to be substantially horizontally aligned and the pivot bars have been moved to be substantially vertically aligned; the apparatus is ready to receive and support a mattress. In the preferred embodiments, there is no need to open the closed apparatus and then flip the whole apparatus upside down; in the preferred embodiments, immediately upon opening the apparatus from a closed position to an open position, all of the foot rests are resting on the ground and the support rods for the mattress are facing the ceiling and ready to receive a mattress.

Figure 14:
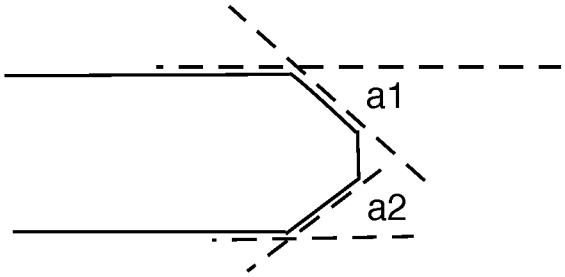
FIG. 14 illustrates a side profile of a medial-facing end of a side bar, such as a distal side bar of the second lower frame, having a flat beveled edge.

FIG. 14 illustrates a side profile of a medial-facing end of a side bar, such as a distal side bar of the second lower frame, having a flat beveled edge. The apparatus may have a plurality of the beveled edges each including a beveling angle; wherein the plurality of beveling angles each comprise an acute angle (a first acute angle is depicted as al; a second acute angle is depicted as al) disposed between a horizontal line tangent to a longitudinal edge of the side bar and a line parallel to a longest portion of a beveled edge, when the beveled edge is not curved; wherein the angle measure of each beveling angle is between 30 degrees and 75 degree.

Figure 15:
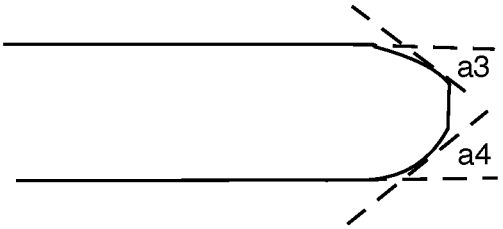
FIG. 15 illustrates a side profile of a medial-facing end of a side bar, such as a distal side bar of the second lower frame, having a curved beveled edge.

FIG. 15 illustrates a side profile of a medial-facing end of a side bar, such as a distal side bar of the second lower frame, having a curved beveled edge. The apparatus may have a plurality of the beveled edges each including a beveling angle; wherein the plurality of beveling angles each comprise an acute angle (a third acute angle is depicted as a3; a fourth acute angle is depicted as a4), disposed between a horizontal line tangent to a longitudinal edge of the side bar; and a line tangent to the beveled edge, when the beveled edge is curved wherein the angle measure of each beveling angle is between 30 degrees and 75 degrees.

Although several variations and embodiments have been described in detail above, various modifications may be made without departing from the scope and spirit of the invention.

What is claimed is:

1. A folding bed base apparatus comprising:

a first hinge body comprising:

a first vertical bar;

a first upper horizontal member coupled to a superior end of the first vertical bar;

a first lower horizontal member coupled to an inferior end of the first vertical bar; and a first medial leg support coupled to an inward-facing face of the first vertical bar;

a second hinge body comprising:

a second vertical bar;

a second upper horizontal member coupled to a superior end of the second vertical bar;

a second lower horizontal member coupled to an inferior end of the second vertical bar; and a second medial leg support coupled to an inward facing face of the second vertical bar;

a first upper frame comprising a proximal side bar, a distal side bar, and a lateral end bar, wherein the proximal side bar of the first upper frame further comprises a medial-facing end having a first medial-facing end aperture-area, an upper surface of the proximal side bar of the first upper frame, and a lower surface wherein the lower surface comprises a beveled edge of the proximal side bar of the first upper frame; wherein the proximal side bar of the first upper frame is pivotally attached to the second upper horizontal member of the second hinge body via a bolt inserted through the first medial-facing end aperture-area; wherein the distal side bar of the first upper frame further comprises a medial-facing end having a second medial-facing end aperture-area, an-upper surface of the distal side bar of the first upper frame, and a lower surface wherein the lower surface comprises a beveled edge of the distal side bar of the first upper frame; wherein the distal side bar of the first upper frame is pivotally attached to the first upper horizontal member of the first hinge body via a bolt inserted through the second medial-facing end aperture-area;

a second upper frame, comprising a proximal side bar, a distal side bar, and a lateral end bar, wherein the proximal side bar of the second upper frame further comprises a medial-facing end having a third medial-facing end aperture-area, an upper surface of the proximal side bar of the second upper frame, and a lower surface wherein the lower surface comprises a beveled edge of the proximal side bar of the second upper frame; wherein the proximal side bar of the second upper frame is pivotally attached to the second upper horizontal member of the second hinge body via a bolt inserted through the third medial-facing end aperture-area; wherein the distal side bar of the second upper frame further comprises a medial-facing end having a fourth medial-facing end aperture-area, an upper surface of the distal side bar of the second upper frame, and a lower surface; wherein the lower surface comprises a beveled edge of the distal side bar of the second upper frame; wherein the medial-facing end of the distal side bar of the second upper frame is pivotally attached to the first upper horizontal member of the first hinge body via a bolt inserted through the fourth medial-facing end aperture-area;

a first lower frame, comprising a proximal side bar, a distal side bar, and a lateral end bar, wherein the proximal side bar of the first lower frame further comprises a medial-facing end having a fifth medial-facing end aperture-area, an upper surface and a lower surface of the proximal side bar of the first lower frame; wherein the upper surface comprises a beveled edge of the proximal side bar of the first lower frame; wherein the proximal side bar of the first lower frame is pivotally attached to the second lower horizontal member of the second hinge body via a bolt inserted through the fifth medial-facing end aperture-area; wherein the distal side bar of the first lower frame further comprises a medial-facing end having a sixth medial-facing end aperture-area, an upper surface and a lower surface of the distal side bar of the first lower frame; wherein the upper surface comprises a beveled edge of the distal side bar of the first lower frame; wherein the medial-facing end of the distal side bar of the first lower frame is pivotally attached to the first lower horizontal member of the first hinge body via a bolt inserted through the sixth medial-facing end aperture-area;

a second lower frame, comprising a proximal side bar, a distal side bar, and a lateral end bar, wherein the proximal side bar of the second lower frame further comprises a medial-facing end having a seventh medial facing end aperture-area, an upper surface, and a lower surface of the proximal side bar of the second lower frame; wherein the upper surface comprises a beveled edge of the proximal side bar of the second lower frame; wherein the proximal side bar of the second lower frame is pivotally attached to the second lower horizontal member of the second hinge body via a bolt inserted through the seventh medial-facing end aperture-area; wherein the distal side bar of the second lower frame further comprises a medial-facing end having an eighth medial-facing end aperture-area, an upper surface, and a lower surface of the distal side bar of the second lower frame; wherein the upper surface comprises a beveled edge of the distal side bar of the second lower frame; wherein the medial-facing end of the distal side bar of the second lower frame is pivotally attached to the first lower horizontal member of the first hinge body via a bolt inserted through the eighth medial-facing end aperture-area;

a central support bar, wherein a distal end of the central support bar is coupled to the first hinge body and a proximal end of the central support bar is coupled to the second hinge body; and, a first U-shaped foot rest, wherein the first U-shaped foot rest is removably attached to the first medial leg support;

a second U-shaped foot rest, wherein the second U-shaped foot rest is removably attached to the second medial leg support;

a first pivot bar comprising a first pivot support bar having a first proximal lateral end and a first distal lateral end;

a first distal vertical bar coupled, by a superior end of the distal vertical bar, to the first distal lateral end of the pivot support bar, an inferior end of the first distal vertical bar comprising a first distal vertical bar hinge; wherein the first distal vertical bar hinge is pivotally attached to a first pivot bar aperture-area of the first lower frame; and, a first proximal vertical bar coupled, by a superior end of the proximal vertical bar, to the first proximal lateral end of the pivot support bar, an inferior end of the first proximal vertical bar comprising a first proximal vertical bar hinge; wherein the first proximal vertical bar hinge is pivotally attached to first pivot bar aperture-area of the first lower frame; and, a second pivot bar comprising a second pivot support bar having a second proximal lateral end and a second distal lateral end;

a second distal vertical bar coupled, by a superior end of the second distal vertical bar, to the second distal lateral end of the second pivot support bar, an inferior end of the second distal vertical bar comprising a second distal vertical bar hinge; wherein the second distal vertical bar hinge is pivotally attached to a second pivot bar aperture-area of the second lower frame; and, a second proximal vertical bar coupled, by a superior end of the second proximal vertical bar, to the second proximal lateral end of the pivot support bar, an inferior end of the second proximal vertical bar comprising a second proximal vertical bar hinge; wherein the second proximal vertical bar hinge is pivotally attached to second pivot bar aperture-area of the second lower frame.

2. The apparatus of claim 1 wherein the upper surface of the proximal side bar of the first upper frame comprises a beveled edge; wherein the-upper surface of the distal side bar of the first upper frame comprises a beveled edge; wherein the upper surface of the proximal side bar of the second upper frame comprises a beveled edge; wherein the upper surface of the distal side bar of the second upper frame comprises a beveled edge; wherein the lower surface of the proximal side bar of the first lower frame comprises a beveled edge; wherein the lower surface of the distal side bar of the first lower frame comprises a beveled edge; wherein the lower surface of the proximal side bar of the second lower frame comprises a beveled edge; and, wherein the lower surface of the distal side bar of the second lower frame comprises a beveled edge.

3. The apparatus of claim 2 wherein the plurality of the beveled edges each comprise a beveling angle; wherein the plurality of beveling angles each comprise an acute angle disposed between a horizontal line tangent to a longitudinal edge of the side bar and a) a line tangent to the beveled edge, when the beveled edge is curved, or b) a line parallel to a longest portion of a beveled edge, when the beveled edge is not curved; wherein the angle measure of each beveling angle is between 30 degrees and 75 degrees.

4. The apparatus of claim 2 wherein each beveling angle of the plurality of beveling angles is between 35 degrees and 55 degrees.

5. The apparatus of claim 2 wherein each beveling angle of the plurality of beveling angles is between 42 degrees and 53 degrees.

6. The apparatus of claim 2 wherein each beveling angle of the plurality of beveling angles is between 48 degrees and 52 degrees.

7. The apparatus of claim 2 wherein each beveling angle of the plurality of beveling angles is 50 degrees.

8. The apparatus of claim 2 wherein at least two of the beveled edges are defined by an arc of a circle.

9. The apparatus of claim 2 wherein at least two of the beveled edges are defined by an arc of an ellipsis.

10. The apparatus of claim 2 wherein all of the beveled edges are defined by an arc of a circle.

11. The apparatus of claim 2 wherein all of the beveled edges are defined by an arc of an ellipsis.

12. The folding bed base apparatus of claim 1, wherein the first lower frame further comprises a first pivot bar stop and a second pivot bar stop, wherein the first pivot bar stop is coupled to the distal side bar of the first lower frame and the second pivot bar stop is coupled to the proximal side bar of the first lower frame, wherein the first pivot bar stop and the second pivot bar stop frictionally-obstruct the first pivot bar from rotating clockwise past a twelve-o-clock position in which a proximal vertical bar of the first pivot bar is orthogonal to the proximal side bar of the first lower frame; the second lower frame further comprises a first pivot bar stop and a second pivot bar stop, wherein the first pivot bar stop is coupled to the distal side bar of the second lower frame and the second pivot bar stop is coupled to the proximal side bar of the second lower frame, wherein the first pivot bar stop and the second pivot bar stop frictionally-obstruct the second pivot bar from rotating counterclockwise past a twelve-o-clock position in which a proximal vertical bar of the first pivot bar is orthogonal to the proximal side bar of the second lower frame.

13. The folding bed base apparatus of claim 12, further comprising a fabric covering.

14. The folding bed base apparatus of claim 12, further comprising a fabric covering engulfing the first upper frame, the second upper frame, the first lower frame, and the second lower frame; wherein each beveling angle of the plurality of beveling angles is between 48 degrees and 52 degrees.

15. The apparatus of claim 1, wherein a height of the first U-shaped foot rest is between 15% and 90% of a main length of the first U-shaped foot rest; wherein the height of the second U-shaped foot rest is between 15% and 90% of a main length of the second U-shaped foot rest.

16. The apparatus of claim 1, wherein a height of the first U-shaped foot rest is between 30% and 70% of a main length of the first U-shaped foot rest; wherein the height of the second U-shaped foot rest is between 30% and 70% of a main length of the second U-shaped foot rest.

17. A method for using a folding bed base apparatus comprising:

providing a folding bed base apparatus comprising a first hinge body comprising:

a first vertical bar;

a first upper horizontal member coupled to a superior end of the first vertical bar;

a first lower horizontal member coupled to an inferior end of the first vertical bar; and a first medial leg support coupled to an inward-facing face of the first vertical bar;

a second hinge body comprising:

a second vertical bar;

a second upper horizontal member coupled to a superior end of the second vertical bar;

a second lower horizontal member coupled to an inferior end of the second vertical bar;

a second medial leg support coupled to an inward facing face of the second vertical bar;

a first upper frame comprising a proximal side bar, a distal side bar, and a lateral end bar, wherein the proximal side bar of the first upper frame further comprises a medial-facing end having a first medial-facing end aperture-area, an upper surface of the proximal side bar of the first upper frame, and a lower surface wherein the lower surface comprises a beveled edge of the proximal side bar of the first upper frame; wherein the proximal side bar of the first upper frame is pivotally attached to the second upper horizontal member of the second hinge body via a bolt inserted through the first medial-facing end aperture-area; wherein the distal side bar of the first upper frame further comprises a medial-facing end having a second medial-facing end aperture-area, an-upper surface of the distal side bar of the first upper frame, and a lower surface wherein the lower surface comprises a beveled edge of the distal side bar of the first upper frame; wherein the distal side bar of the first upper frame is pivotally attached to the first upper horizontal member of the first hinge body via a bolt inserted through the second medial-facing end aperture-area; wherein the first upper frame is substantially vertically-aligned;

a second upper frame, comprising a proximal side bar, a distal side bar, and a lateral end bar, wherein the proximal side bar of the second upper frame further comprises a medial-facing end having a third medial-facing end aperture-area, an upper surface of the proximal side bar of the second upper frame, and a lower surface wherein the lower surface comprises a beveled edge of the proximal side bar of the second upper frame; wherein the proximal side bar of the second upper frame is pivotally attached to the second upper horizontal member of the second hinge body via a bolt inserted through the third medial-facing end aperture-area; wherein the distal side bar of the second upper frame further comprises a medial-facing end having a fourth medial-facing end aperture-area, an upper surface of the distal side bar of the second upper frame, and a lower surface; wherein the lower surface comprises a beveled edge of the distal side bar of the second upper frame; wherein the medial-facing end of the distal side bar of the second upper frame is pivotally attached to the first upper horizontal member of the first hinge body via a bolt inserted through the fourth medial-facing end aperture-area; wherein the second upper frame is substantially vertically-aligned;

a first lower frame, comprising a proximal side bar, a distal side bar, and a lateral end bar, wherein the proximal side bar of the first lower frame further comprises a medial-facing end having a fifth medial-facing end aperture-area, an upper surface and a lower surface of the proximal side bar of the first lower frame; wherein the upper surface comprises a beveled edge of the proximal side bar of the first lower frame; wherein the proximal side bar of the first lower frame is pivotally attached to the second lower horizontal member of the second hinge body via a bolt inserted through the fifth medial-facing end aperture-area; wherein the distal side bar of the first lower frame further comprises a medial-facing end having a sixth medial-facing end aperture-area, an upper surface and a lower surface of the distal side bar of the first lower frame; wherein the upper surface comprises a beveled edge of the distal side bar of the first lower frame; wherein the medial-facing end of the distal side bar of the first lower frame is pivotally attached to the first lower horizontal member of the first hinge body via a bolt inserted through the sixth medial-facing end aperture-area; wherein the first lower frame is substantially vertically-aligned;

a second lower frame, comprising a proximal side bar, a distal side bar, and a lateral end bar, wherein the proximal side bar of the second lower frame further comprises a medial-facing end having a seventh medial facing end aperture-area, an upper surface, and a lower surface of the proximal side bar of the second lower frame; wherein the upper surface comprises a beveled edge of the proximal side bar of the second lower frame; wherein the proximal side bar of the second lower frame is pivotally attached to the second lower horizontal member of the second hinge body via a bolt inserted through the seventh medial-facing end aperture-area; wherein the distal side bar of the second lower frame further comprises a medial-facing end having an eighth medial-facing end aperture-area, an upper surface, and a lower surface of the distal side bar of the second lower frame; wherein the upper surface comprises a beveled edge of the distal side bar of the second lower frame; wherein the medial-facing end of the distal side bar of the second lower frame is pivotally attached to the first lower horizontal member of the first hinge body via a bolt inserted through the eight medial-facing end aperture-area; wherein the second lower frame is substantially vertically-aligned;

wherein the first lower frame further comprises a first pivot bar stop and a second pivot bar stop, wherein the first pivot bar stop is coupled to the distal side bar of the first lower frame and the second pivot bar stop is coupled to the proximal side bar of the first lower frame, wherein the first pivot bar stop and the second pivot bar stop frictionally-obstruct the first pivot bar from rotating clockwise past a twelve-o-clock position in which a proximal vertical bar of the first pivot bar is orthogonal to the proximal side bar of the first lower frame; the second lower frame further comprises a first pivot bar stop and a second pivot bar stop, wherein the first pivot bar stop is coupled to the distal side bar of the second lower frame and the second pivot bar stop is coupled to the proximal side bar of the second lower frame, wherein the first pivot bar stop and the second pivot bar stop frictionally-obstruct the second pivot bar from rotating counterclockwise past a twelve-o-clock position in which a proximal vertical bar of the first pivot bar is orthogonal to the proximal side bar of the second lower frame;

a central support bar, wherein a distal end of the central support bar is coupled to the first hinge body and a proximal end of the central support bar is coupled to the second hinge body; wherein the central support bar is horizontally-aligned; and, a first U-shaped foot rest, wherein the first U-shaped foot rest is coupled to the first medial leg support;

a second U-shaped foot rest, wherein the second U-shaped foot rest is coupled to the second medial leg support;

a first pivot bar comprising a first hinge and a second hinge, wherein the first hinge of the first pivot bar is pivotally attached to a first pivot bar aperture-area of the first lower frame; the second hinge of the first pivot bar is pivotally attached to a second pivot bar aperture-area of the first lower frame;

a second pivot bar comprising a first hinge and a second hinge, wherein the first hinge of the second pivot bar is pivotally attached to a third pivot bar aperture-area of the second lower frame; and, the second hinge of the second pivot bar is pivotally attached to a fourth pivot bar aperture-area of the second lower frame.

18. The method of claim 17; wherein providing the folding bed base apparatus further comprises providing a fabric covering having a zipper, wherein the fabric covering engulfs the folding bed base apparatus.

19. The method of claim 18 further comprising the steps of:

rotating the first upper frame from being vertically-aligned to being horizontally-aligned while almost simultaneously rotating the first pivot bar from being substantially horizontally-aligned to being substantially vertically-aligned wherein a plurality of positions of the first pivot bar, the first pivot bar stop, and the second pivot bar stop when the pivot bar is vertically-aligned is such that the first pivot bar is frictionally obstructed by the first pivot bar stop and frictionally obstructed by the second pivot bar stop from a) rotating, in a direction away from the nearest lateral end bar, greater than 15 degrees past being vertically-aligned;

rotating the first lower frame from being vertically-aligned to being horizontally-aligned;

rotating the second upper frame from being vertically-aligned to being horizontally-aligned wherein the step of rotating the second upper frame from being vertically-aligned to being horizontally aligned;

rotating, almost simultaneously with respect to the step of rotating the second upper frame, the first pivot bar from being substantially horizontally-aligned to being substantially vertically-aligned wherein the relative positions to each other of the first pivot bar, the first pivot bar stop, and the second pivot bar stop when the pivot bar is vertically-aligned is such that the first pivot bar is frictionally obstructed by the first pivot bar stop and frictionally obstructed by the second pivot bar stop from rotating, in a direction away from the nearest lateral end bar, greater than 15 degrees past being vertically-aligned and;

rotating the second lower frame from being vertically-aligned to being horizontally-aligned;

rotating the first pivot bar from being horizontally-aligned to being vertically-aligned;

rotating the second pivot bar from being horizontally-aligned to being vertically-aligned;

placing a mattress having a mass so that the mass of mattress substantially rests on the first upper frame and on the second upper frame.

20. The method of claim 19 wherein the step of rotating the second upper frame from being vertically-aligned to being horizontally-aligned wherein the step of rotating the second upper frame from being vertically-aligned to being horizontally aligned further comprises contacting both the first U-shaped foot rest and a second U-shaped foot rest to the ground.

* * * * *